US005160035A

United States Patent [19]

McConnell

[11] Patent Number: 5,160,035

[45] Date of Patent: Nov. 3, 1992

[54] PARTICLE CONCENTRATOR AND METHOD OF OPERATION

[75] Inventor: David P. McConnell, Apache Junction, Ariz.

[73] Assignee: Cosmos Systems, Inc., Phoenix, Ariz.

[21] Appl. No.: 515,081

[22] Filed: Apr. 26, 1990

[51] Int. Cl.[5] ..... B03B 5/02; B03B 5/06

[52] U.S. Cl. ..... 209/439; 209/500; 209/504; 209/506

[58] Field of Search ..... 209/437, 438, 439, 446, 209/479, 480, 488, 506, 490, 497, 498, 500, 503, 504, 507, 18, 434, 472, 435, 445, 442, 481, 436

[56] References Cited

U.S. PATENT DOCUMENTS

| | | | |
|---|---|---|---|
| 130,478 | 8/1872 | Chubb | 209/438 X |
| 995,089 | 6/1911 | Pinder | 209/439 |
| 1,387,075 | 8/1921 | Rueger | 209/439 |
| 1,650,726 | 11/1927 | Stebbins | 209/439 X |
| 1,964,716 | 7/1934 | Ater | 209/506 X |
| 1,985,513 | 12/1934 | McCleery | 209/444 X |
| 1,986,778 | 1/1935 | Hinkley | 209/452 |
| 2,199,091 | 4/1940 | Pardee | 209/498 X |
| 3,367,499 | 2/1968 | Motosi | 209/445 |
| 4,078,996 | 3/1978 | Cohen-Alloro et al. | 209/504 X |
| 4,793,918 | 12/1988 | Thomas | 209/504 X |
| 4,946,586 | 8/1990 | Fletcher | 209/438 |

FOREIGN PATENT DOCUMENTS 8910196 11/1989 World Int. Prop. O. ..... 209/479

*Primary Examiner*—Donald T. Hajec
*Attorney, Agent, or Firm*—John A. Bucher

[57] ABSTRACT

A particle concentrator and method of operation are disclosed wherein the concentrator includes a concentrator deck, preferably having an inverted frustoconical configuration with substantial portions of the deck being vertically inclined, an eccentric drive for producing rotary oscillating movement of the deck with low density and high density particle outlets respectively formed on an axially central portion of the deck and a peripheral portion of the deck. Riffle elements are angularly formed on the deck to facilitate particle separation with a mechanical stop limiting travel of the deck in a direction selected for propelling the higher density particles along the riffle elements toward the high density outlet. The concentrator may be operated either dry or submerged under standing liquid, with annular inclination of the deck, angular pitch of the riffle elements and height of the riffle elements on the concentrator deck being selected to facilitate classification and separation of the particles.

23 Claims, 12 Drawing Sheets

PARTICLE CONCENTRATOR AND METHOD OF OPERATION

FIELD OF THE INVENTION

The present invention relates to a particle concentrator and method of operation and more particularly to such a concentrator and method of operation wherein a concentrator deck is operated in rotary oscillation to facilitate particle separation thereon.

BACKGROUND OF THE INVENTION

A wide variety of particle concentrators have been provided in the prior art, the simplest of these devices possibly being a pan which gold prospectors and the like filled with water and rotated for concentrating relatively heavy particles such as gold ore.

However, substantially more complex particle separators have been developed in order to facilitate the classification and separation of large quantities of particles, for example, in the mining industry for recovering small quantities of desirable particles such as gold and other heavy metals from very large quantities of ore particles.

It is to be understood that such particle concentrators may also be employed for recovering relatively low density particles such as coal from higher density ore or rock particles.

Some of the earliest particle concentrators included pans similar to those employed by gold prospectors as noted above. For example, U.S. Pat. No. 1,132,317 issued Mar. 16, 1915 to Farmer disclosed an amalgamator including a pan suspended for oscillating and swinging movement, the pan being coated with quicksilver for concentrating and amalgamating gold and other precious metals.

U.S. Pat. No. 286,342 issued Oct. 9, 1883 to Stirk disclosed a similar device with a pan supported for rotating and shaking movement in order to separate heavy and light ore particles.

These pan devices were replaced in some instances by rotating tables having their axes substantially inclined and having riffles formed on the rotating tables. Vertical inclination of the table was sufficient so that relatively high density particles were removed through a heavy concentrate outlet centrally formed at the axis of rotation for the tables. Such devices were , for example, in U.S. Pat. No. 1,141,972 issued Jun. 8, 1915 to Muhleman and U.S. Pat. No. 1,986,778 issued Jan. 1, 1935 to Hinkley.

A similar device was disclosed for separating beans into different grades in U.S. Pat. No. 1,479,082 issued Jan. 1, 1924 to Medcalf.

U.S. Pat. No. 4,008,152 issued Feb. 15, 1977 to Kleven and disclosed a metal separating process and apparatus wherein multiple inclined tables as disclosed above were operated in rotation and in series to further facilitate recovery of heavy metals. U.S. Pat. No. 1,985,513 issued Dec. 25, 1934 to McCleery and disclosed a similar concentrator employing one rotating disc constructed and operating similarly as described in the above patent.

Among more recent developments, U.S. Pat. No. 4,538,735 issued Sep. 3, 1985 to Boom, et al. disclosed apparatus for separating solids of different shapes, the apparatus including a table having a frustoconical surface and being driven in rotation for separating round and irregularly shaped solids. U.S. Pat. No. 4,068,758 issued Jan. 17, 1978 to Abdul-Rahman disclosed a feed system for a "conoidal solids separating system" and method of separating including a device generally similar to that described for the above patent.

An ore separator apparatus for separating particles of different densities was disclosed in U.S. Pat. No. 4,522,711 issued Jun. 11, 1985 to Cleland, the apparatus including a bowl with an inner liner of spiral grooves or riffles, the bowl being tilted on its axis and driven in rotation for separating ore particles. Vertical inclination of the bowl was selected so that concentrated heavy ore particles exited through a central opening in the bowl. U.S. Pat. No. 4,389,308 issued Jun. 21, 1983 also to Cleland was cited in the above patent and included apparatus of similar construction and operation.

U.S. Pat. No. 2,484,203 issued Oct. 11, 1949 to Beck also disclosed an oscillating placer separating machine including a frustoconical pan driven in oscillating rotation by a drive bar coupled eccentrically to a drive disk and to the pan for separating ore particles. In this machine, the apex or center of the frustoconical pan extends upwardly to facilitate separation as discussed in the patent.

Finally, a number of prior art devices include concentrating tables or "shaker tables" which are subjected to vibration or oscillation with water forming over the table for classifying and recovering mineral ores and the like. For example, U.S. Pat. No. 3,269,538 issued Aug. 30, 1966 to Stephan disclosed such a concentrating table having lateral elements forming a "saw tooth" surface on the inclined table which was then subjected to longitudinal oscillation to facilitate particle separation. U.S. Pat. No. 2,091,811 issued Aug. 31, 1937 to Gilbreth disclosed another concentrating table having transverse riffles on an inclined table driven in longitudinal vibratory motion by arms eccentrically coupled to a drive shaft. U.S. Pat. No. 1,964,716 issued Jul. 3, 1934 to Ater. Ater disclosed yet another placer concentrating machine generally similar to that described in the patent noted immediately above.

Yet another concentrating table has been disclosed which is constructed and operated in a manner similar to the above while further including multiple sets of leaf springs packed in lubricant to provide a mounting for facilitating longitudinal oscillation of the concentrating table.

The various devices summarized above indicate the substantial importance of efficiently and effectively separating particles of different densities, particularly but not exclusively in the mining industry. Although the various devices summarized above were generally effective for their intended purposes, it has been found desirable to further improve the effectiveness and efficiency of such concentrators in order to more accurately classify and separate particles of different densities and, for example, to facilitate recovery of very small quantities of desirable particles such as gold and other heavy metals from large quantities of ore. As an example, it is often necessary or desirable to separate only a few ounces of high density ore or even a single ounce or much less from each ton of ore to be processed. Obviously, the efficiency of such a process can be greatly enhanced if complete recovery of the desirable particles can occur in a single operation or a substantially reduced number of operations without the need for employing a relatively large number of concentrators in series to accomplish the necessary separation or classification.

Accordingly, there has been found to remain a need for further improved particle concentrators and methods of operation for facilitating effective and efficient concentration or classification of particles in accordance with the preceding discussion.

SUMMARY OF THE INVENTION

It is therefore an object of the invention to provide an improved particle concentrator and corresponding methods of operation for facilitating effective and efficient concentration or classification of particles of different densities.

It is a further object of the invention to provide a concentrator and method of operation for separating particles of different densities in a device including a concentrator deck having an inverted frustoconical configuration, the deck being driven in rotary oscillating movement about an axis perpendicular to the deck, riffle means being formed on the deck for facilitating separation of particles with outlets for low density particles and high density particles being respectively formed on relatively low elevation and relatively high elevation portions of the deck.

It is further contemplated that annular pitch of the deck, angular pitch of the riffle means on the deck and height of the riffle means are selected for facilitating separation of relatively low and high density particles on the deck and facilitating their travel toward the respective outlet.

Effectiveness of the concentrator as summarized above is further enhanced by scalping means and/or refining means for reducing a selected particle cut on the deck and recycling remaining particles to a lower portion of the deck to further enhance effectiveness and efficiency of the concentrator.

The deck is preferably driven in rotary oscillating movement by eccentric means mounted on a shaft operatively coupled with the deck by bearing means. More preferably, the shaft extends through the axis of the deck with relatively offset eccentric masses being secured to opposite end portions of the shaft.

A further important feature for the concentrator comprises a plurality of vertically arranged leaf springs for supporting the deck on a base structure and permitting rotary oscillating movement of the deck only about its vertical axis.

Yet another important feature for the concentrator includes stop means for limiting travel of the deck in one direction of rotary oscillation. Preferably, the stop means are designed for limiting travel of the deck in a direction of rotary oscillation so that the momentum of higher density particles tends to propel them radially outwardly on the riffle means of the deck toward the high density outlet. Oscillating springs may be employed in combination with the eccentric drive and mechanical stop means for limiting travel of the deck away from the mechanical stop means and for maintaining a desired oscillating cycle or rhythm for the deck.

It is a further object of the invention to provide a particle concentrator including a concentrator deck adapted for receiving particles of different densities and driven in rotary oscillating movement about an axis perpendicular to the deck, separate outlets being provided for high and low density particles with a plurality of vertical leaf springs operatively coupling the deck with a base structure to permit rotary oscillating movement of the deck only about its vertical axis, and a corresponding method of operation.

Preferably, mechanical stop means are provided for limiting travel of the deck in one direction of rotary oscillation, at least a portion of the deck being vertically inclined either by tilting the axis of the deck or by forming the deck, for example, with an inverted frustoconical configuration.

It is yet a further related object of the invention to provide a particle concentrator including a concentrator deck driven in rotary oscillating movement with separate outlets for high and low density particles, stop means limiting travel of the deck in one direction of rotary oscillation selected to enhance vertical classification and separation of particles on the deck.

In the methods summarized above, the concentrator may be operated either dry or wet with the deck submerged under a liquid so that particles on the deck move substantially through standing liquid rather than having the liquid flow or wash over the deck and particles.

It is also an important feature of the method to recycle a middling cut of relatively high density particles from selected portions of the deck and to direct them toward relatively lower elevation portions of the deck for further facilitating effective and efficient particle separation.

Additional objects and advantages of the invention are made apparent in the following description having reference to the accompanying drawings.

DESCRIPTION OF THE PREFERRED EMBODIMENTS

Different embodiments of a particle concentrator constructed in accordance with the present invention are illustrated in the various figures. However, before proceeding with a detailed description of those embodiments, a brief summary description of the concentrator is set forth immediately below followed by a discussion of important features in the various embodiments of the invention. Thereafter, the embodiments of the invention are described in detail with reference to the respective figures and it is believed that an understanding of those embodiments will be facilitated by the following discussion.

Figure 1:
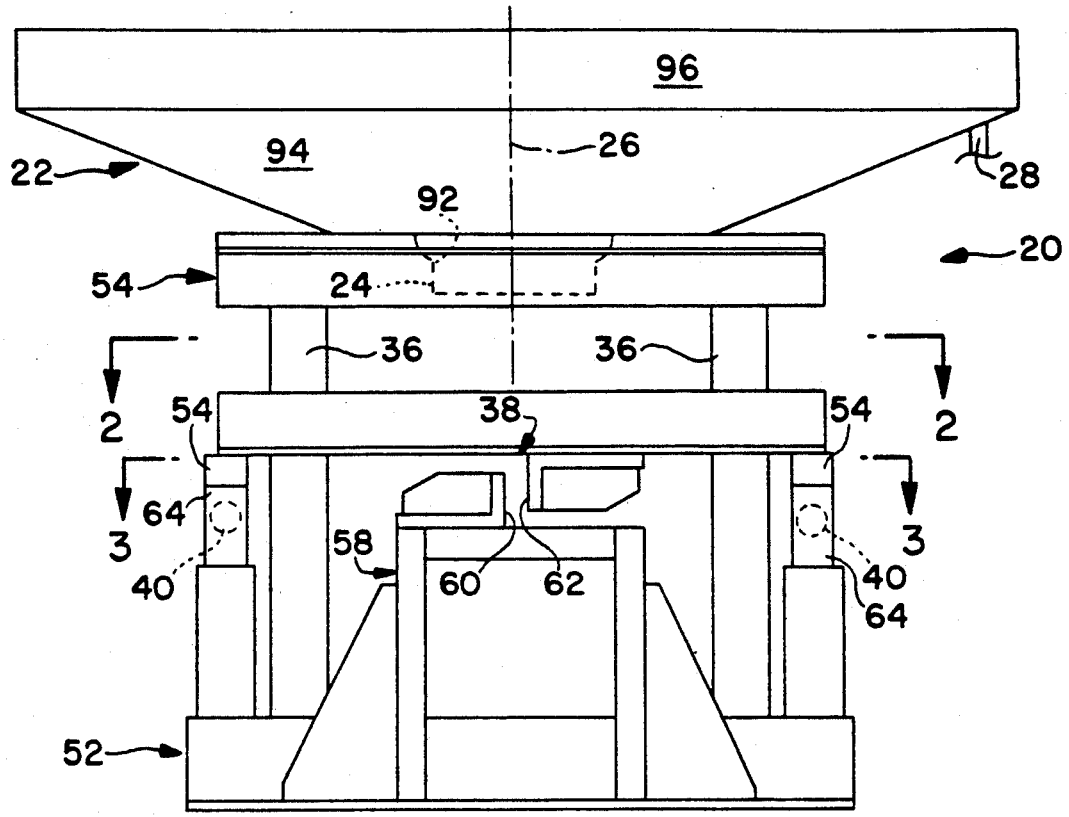
FIG. 1 is a side view in elevation of one embodiment of a particle concentrator constructed in accordance with the present invention and including an inverted frustoconical deck.

One embodiment of a particle concentrator is indicated at 20 in FIG. 1 and includes a deck or table 22 for receiving particles of different densities.

Figure 2:
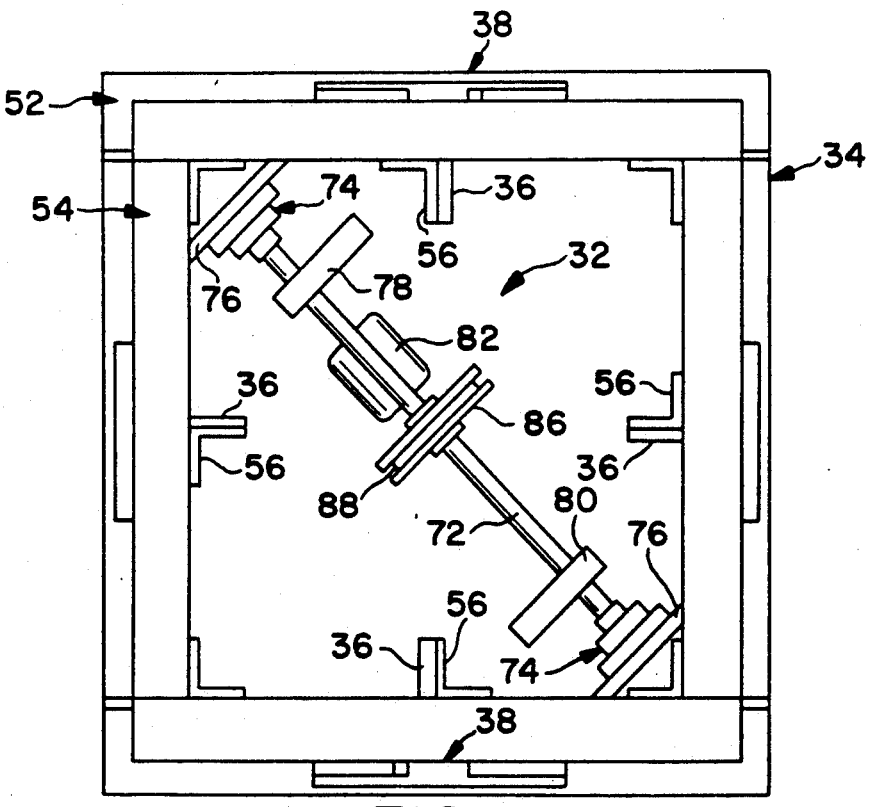
FIG. 2 is a view taken along section line II—II of FIG. 1, with the deck or table removed, to better illustrate a rotary oscillating drive arrangement for the particle concentrator.
Figure 4:
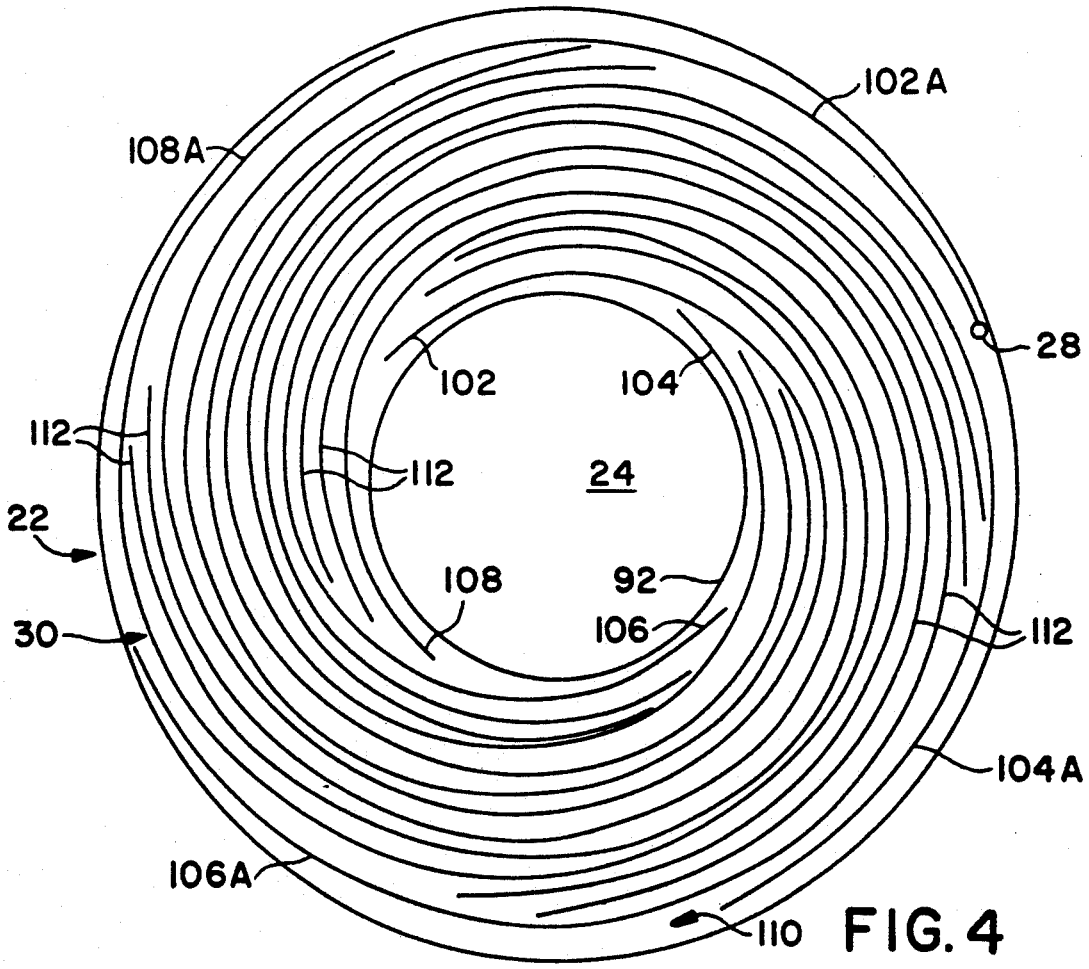
FIG. 4 is a plan view of the particle concentrator of FIG. 1 illustrating the working surface of a concentrator deck with one pattern or embodiment of riffles according to the present invention.
Figure 5:
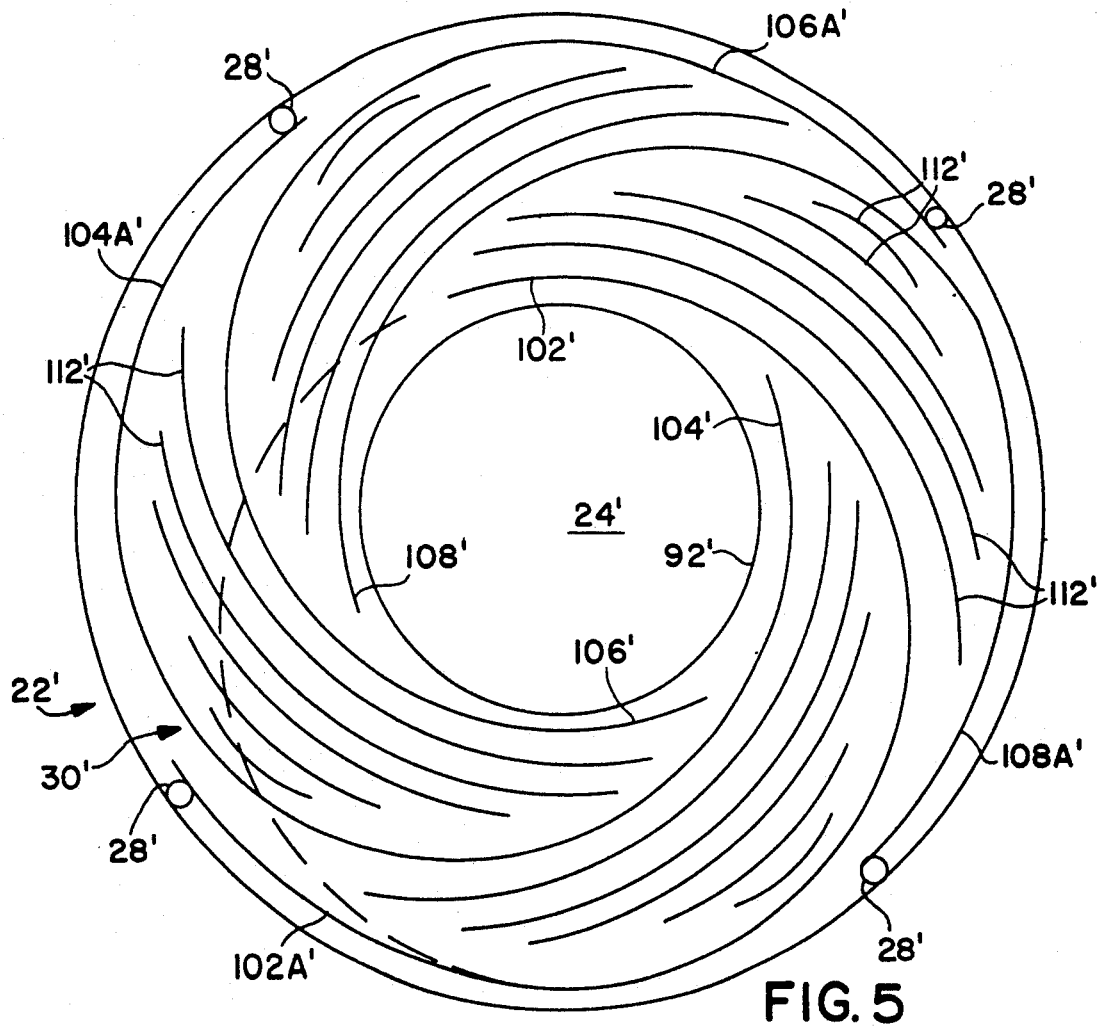
FIG. 5 is a view similar to FIG. 4 while illustrating riffles angularly extending about 180° of the concentrator deck rather than 360° as in the design of FIG. 4.
Figure 10:
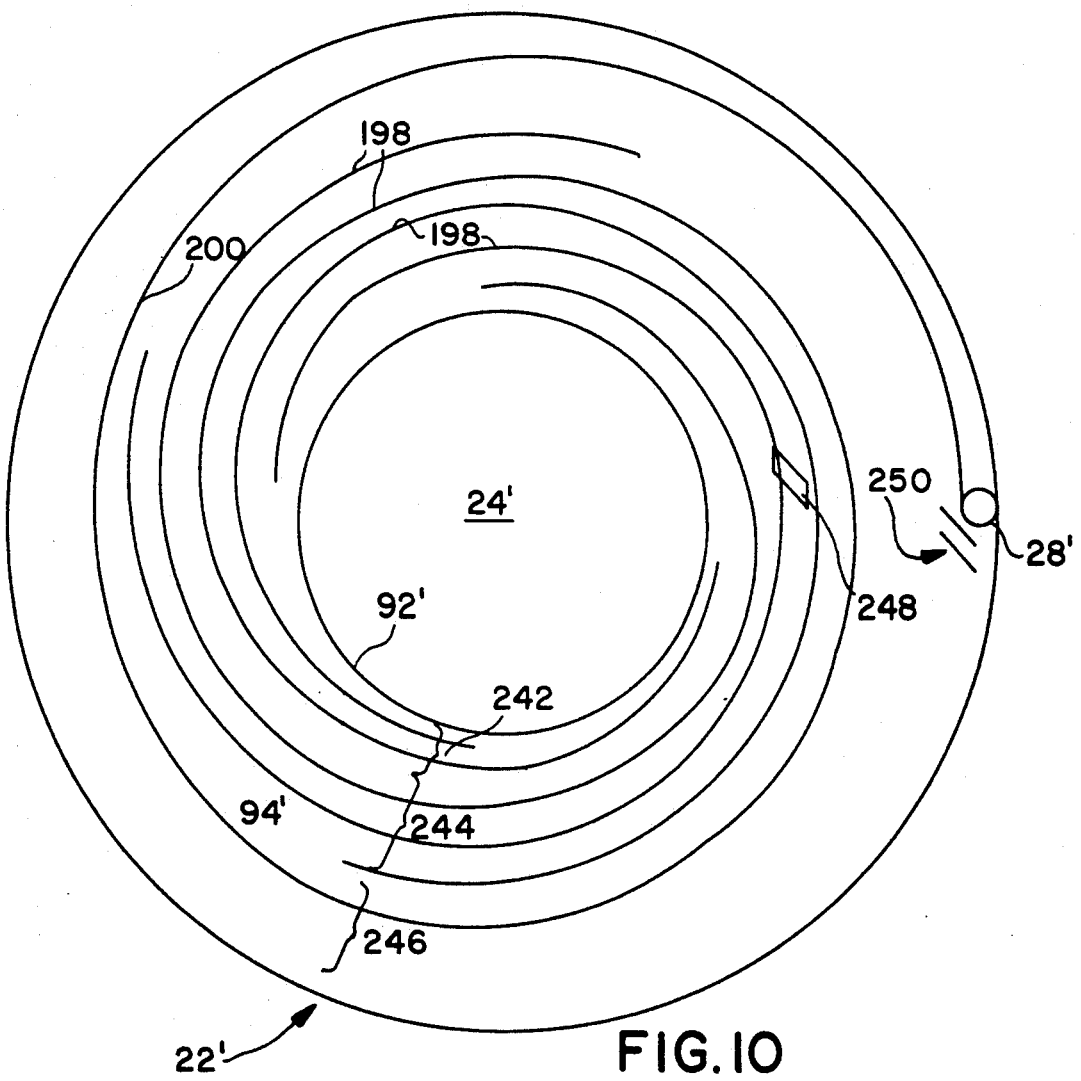
FIG. 10 is a plan view of another embodiment of an inverted frustoconical deck with another variation of a riffle design, also for use with the particle concentrator of FIGS. 1–3.

Referring also to FIG. 2, a low density particle outlet 24 is formed in a relatively lower or central portion of the deck generally adjacent an axis of rotation for the deck as indicated at 26. One or more high density particle outlets 28 are arranged on relatively higher or peripheral portions of the deck 22. With the deck 22 having an inverted frustoconical configuration, the high density particle outlets 28 are thus located above and radially outwardly from the low density particle outlet 24. Although the concentrator deck 22 of FIG. 1 and also the concentrator decks illustrated in FIGS. 4, 5 and 10, are illustrated as having an inverted frustoconical configuration, it is of course also possible that the concentrator of the present invention may be designed with the concentrator deck being of an upright frustoconical configuration having a relatively high center portion and relatively low peripheral portions. In such a design, the low density particle outlets would be on the peripheral portions of the deck with the high density particle outlet means being at the relatively high center of the deck. It is to be noted that such a design is not shown herein and the above variations are noted only to emphasize versatility of the invention. Such an upright configuration could be of particular value, for example, when relatively low density particles form the desired cut to be recovered on the concentrator.

Riffles 30 are formed on the surface of the deck 22 to facilitate particle separation as described in greater detail below, for example with reference to FIG. 4 and 5.

A drive mechanism for operating the deck in rotating oscillating motion is generally indicated at 32 in FIG. 2.

A preferred mounting arrangement for supporting the deck upon a base assembly 34 comprises a plurality of vertically arranged leaf springs 36 also discussed in greater detail below.

Figure 3:
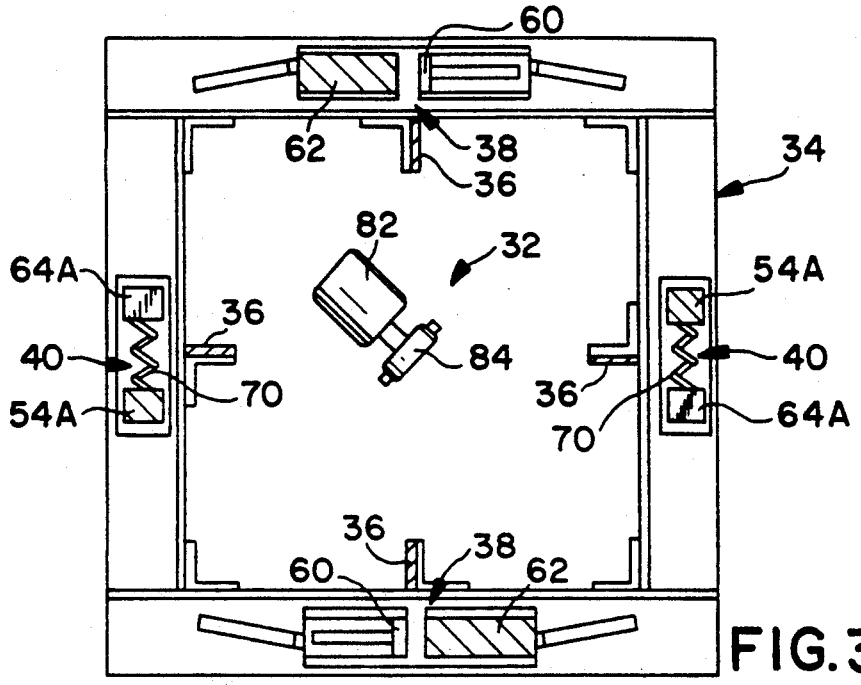
FIG. 3 is a view taken along section line III—III in FIG. 1 to better illustrate the base structure and other associated components for the particle concentrator.

Mechanical stops are indicated at 38 in FIG. 3, et al. for limiting rotary oscillating motion of the deck in one direction. Modulating spring assemblies 40 are also illustrated in FIG. 3 and interact with the mechanical stops 38 to regulate the oscillating sequence or rhythm for the deck.

Figure 8:
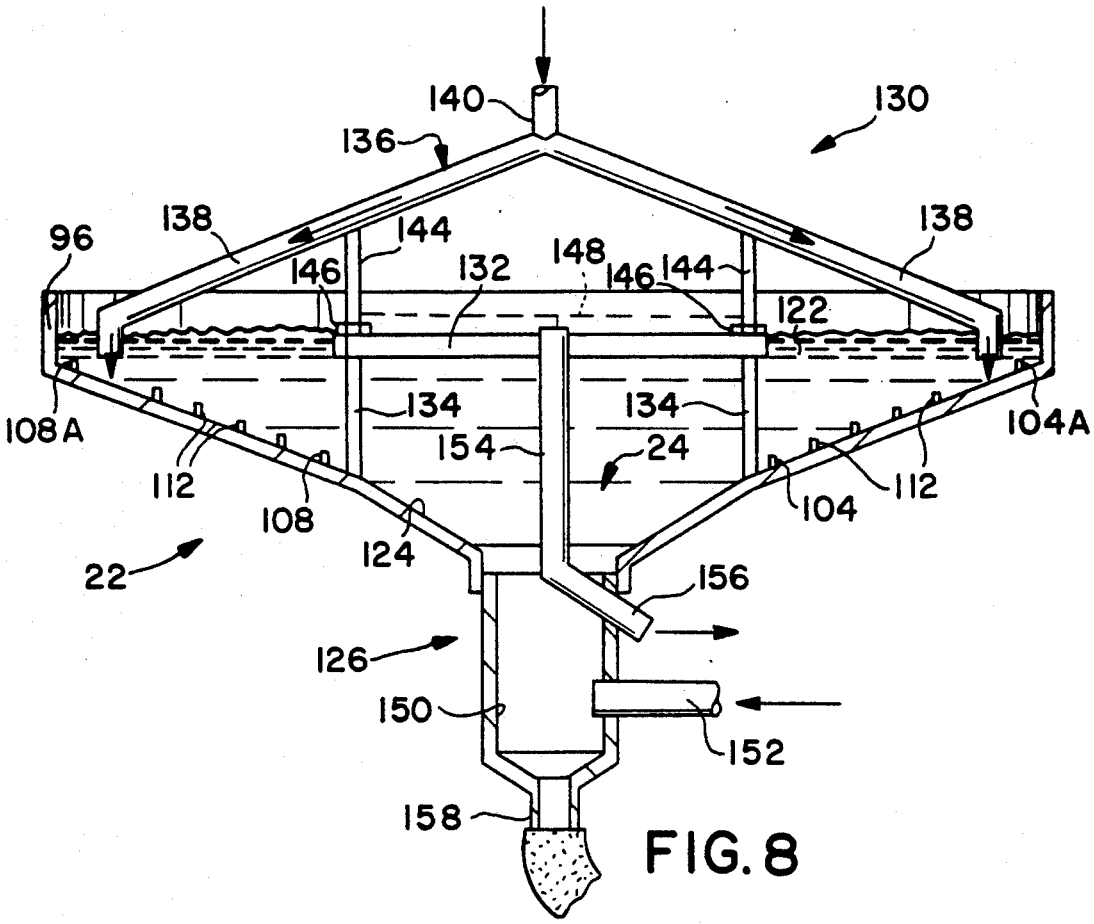
FIG. 8 is a cross sectional view of the concentrator deck illustrated in FIG. 4, the low density particle outlet being modified to maintain a head of standing water on the deck and also including a rotary feed assembly.
Figure 9:
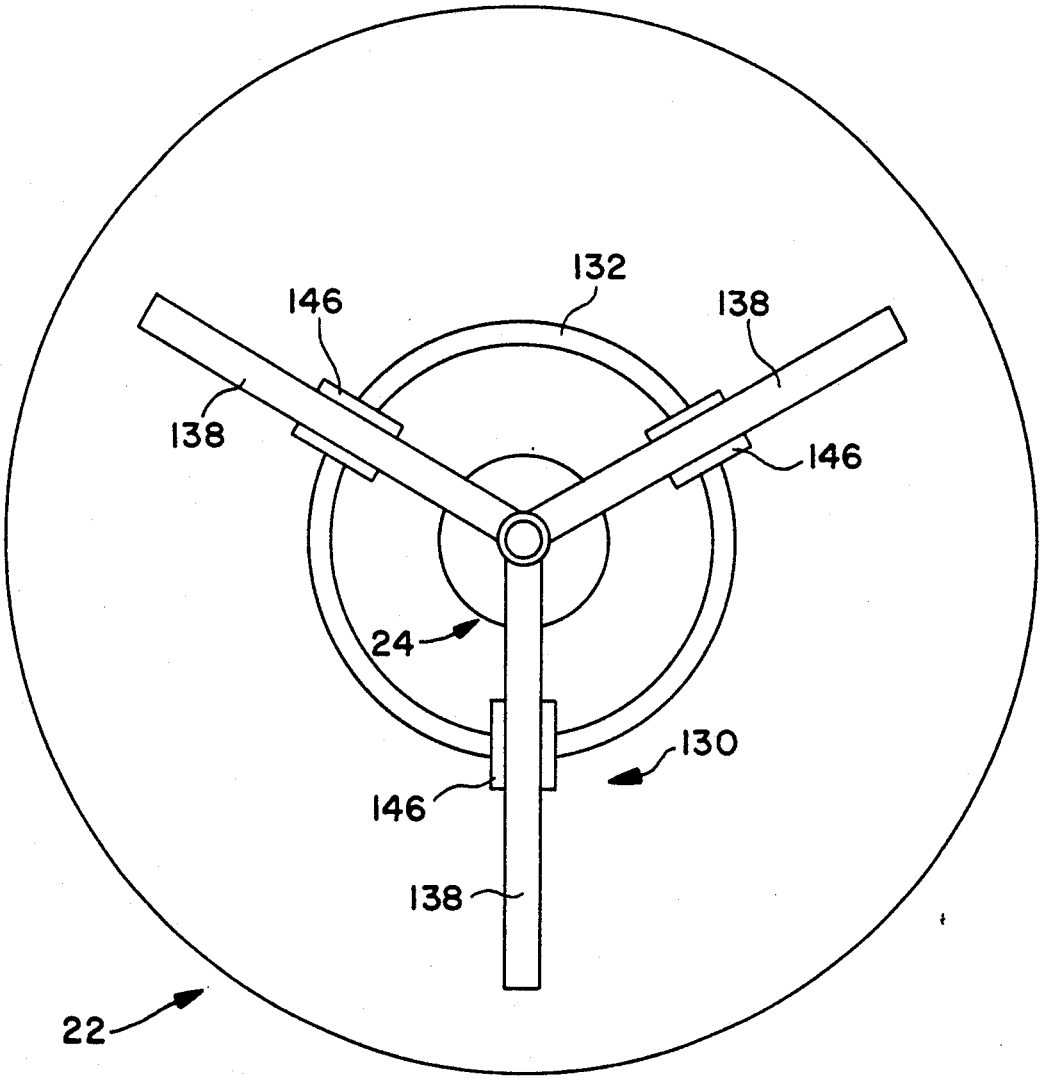
FIG. 9 is a plan view of the deck and rotary feed assembly also illustrated in FIG. 8.

In an embodiment shown in FIGS. 4 and 8, the low density outlet is an assembly also serving to maintain a head of standing water on the deck while mounting a rotary feed assembly also illustrated in FIG. 9.

The following features are particularly important in connection with the present invention.

Initially, the deck, such as that indicated at 22 in FIGS. 1 and 2, is driven in rotary oscillating motion by the drive mechanism 32. Preferably, at least a substantial portion of the deck is vertically inclined in order to further enhance particle separation.

Figure 15:
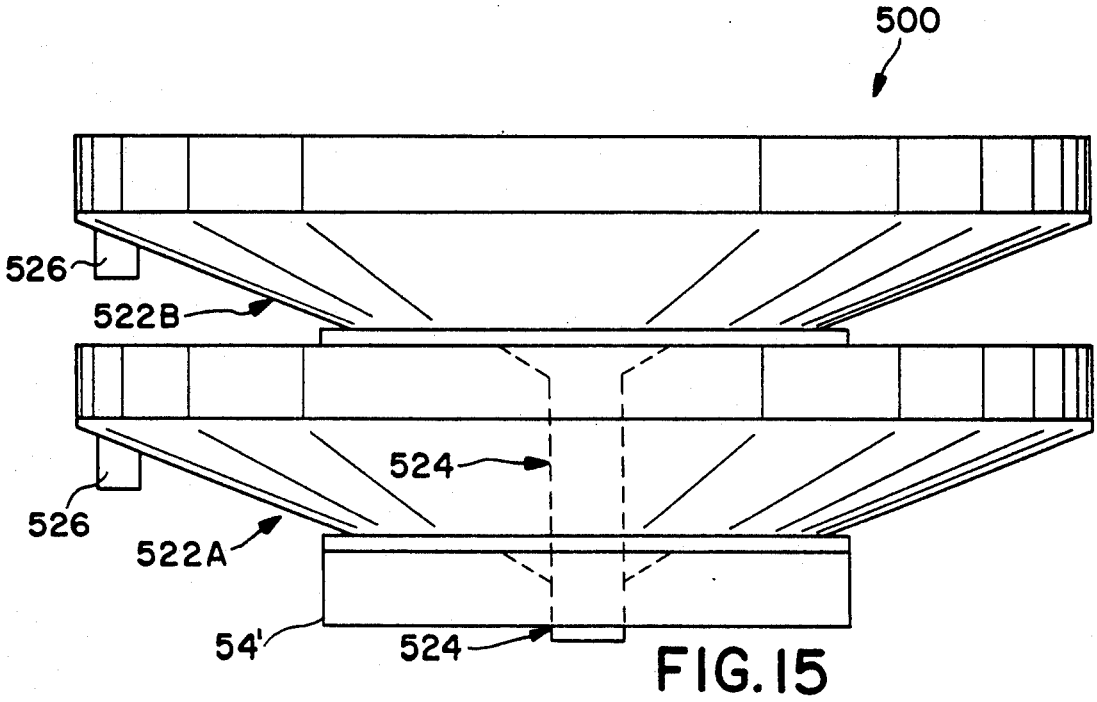
FIG. 15 is a side view in elevation of yet another embodiment of a particle concentrator including stacked decks and also constructed in accordance with the present invention.
Figure 16:
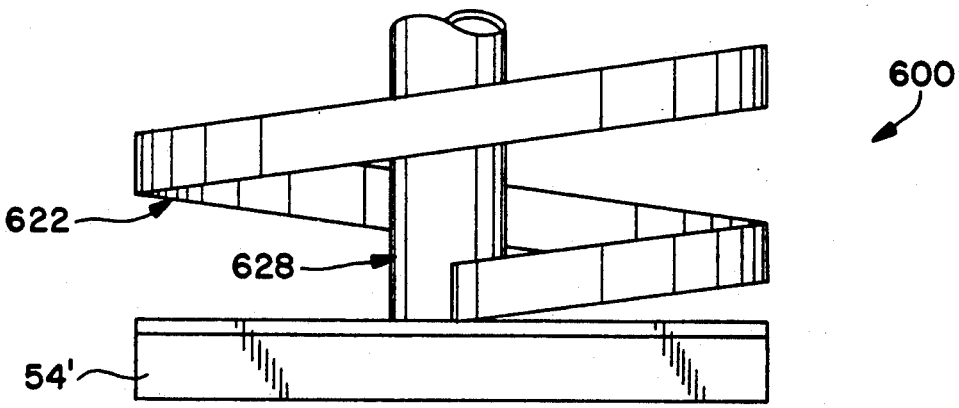
FIG. 16 is a side view in elevation of yet another embodiment of a particle concentrator including a spiral deck and also constructed in accordance with the present invention.

Different variations of the deck include the inverted frustoconical configuration illustrated in FIGS. 1 and 2, an upright frustoconical configuration as noted above, a flat deck as illustrated in FIG. 13 (which may be either horizontal or preferably tilted), an annular configuration effectively achieved by substantially increasing the size of the central low density particle outlet (not shown), a deck having a spiral configuration as illustrated in FIG. 16 and finally multiple decks arranged in stacked relation as illustrated in FIG. 15.

In all of the above configurations for the deck, it is important to note that the low density particle outlet is centrally arranged. This is not true, of course, for the upright frustoconical configuration described above. Also, because of the rotary oscillating motion of the deck about the vertical axis, the central portion of the deck experiences relatively limited travel or motion so that it is effectively "dead space". At the same time, the rotary oscillating motion of the deck in accordance with the present invention as discussed in greater detail below causes relatively low density particles to move radially inwardly with the relatively high density particles moving radially outwardly in accordance with the location of the outlets 24 and 28.

Riffles, such as those indicated at 30 in FIGS. 4, 5, 10, et al., are preferably provided upon the deck to further facilitate particle separation. The riffles can take a variety of shapes and patterns, particularly depending upon the contemplated application for the concentrator and the type of particles to be separated.

For the inverted frustoconical configuration of the deck in FIGS. 1 and 2, the riffles are preferably formed in a circular or spiral configuration angling outwardly and upwardly on the surface of the deck. However, the riffles on the deck could also be straight riffles angularly positioned upon the deck surface to accomplish the same function.

The riffles provide rising surfaces for carrying higher density particles while allowing lower density particles to flow over the riffles and be recycled in a manner discussed in greater detail below.

Figure 13:
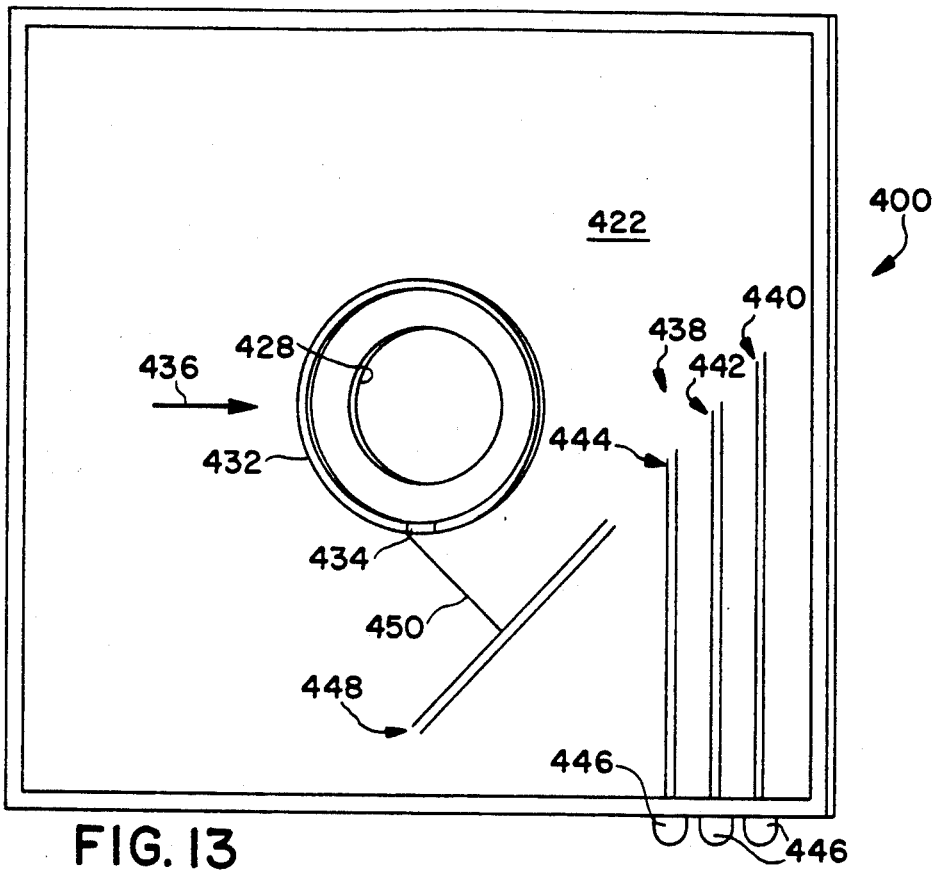
FIG. 13 is a side view in elevation of another embodiment of a particle concentrator including a flat deck and also constructed in accordance with the present invention.

Straight riffles are illustrated upon the flat deck of the concentrator embodiment in FIG. 13. Similar straight riffles could also be employed upon the spiral deck in the embodiment of FIG. 16. However, in that embodiment, the riffles could preferably be radially arranged so that the spiral deck in effect would function in a somewhat similar manner as the shaker tables of the prior art but with a substantially increased length compared to the space occupied by the concentrator.

The drive mechanism 32 for operating the deck in rotating oscillatory motion is preferably provided by opposed and relatively offset eccentric masses mounted on a common shaft secured by bearings to the deck or to a carrier element associated with the deck. Such a drive mechanism is preferred for achieving rotary oscillating movement of the deck.

The leaf springs 36 provide a preferred mounting for the deck. As illustrated, for example, in the embodiment of FIGS. 1–3, the leaf springs 36 provide a preferred mounting for the deck. As illustrated, for example, in the embodiment of FIG. 1, the leaf springs 36 extend vertically between the base assembly 34 and a support member for the deck.

With the leaf springs 36 thus supporting the deck for rotary oscillating movement relative to the base structure, the leaf springs serve three important functions.

Initially, the leaf springs support the deck in spaced apart relation from the base frame so that the deck is free to move in the desired rotary oscillating pattern of motion.

Secondly, the leaf springs tend to modulate or assist in modulating oscillation of the deck in response to the eccentric drive. Note that this function of the leaf springs is important in combination with the mechanical stops 38 and modulating spring assemblies 40 discussed below.

Thirdly, the leaf springs 36 restrain or prevent the deck from moving vertically (or rocking) in natural response to the eccentric drive. Note that the eccentric drive mechanism normally tends to produce both vertical and horizontal oscillating motion in the deck. However, the leaf springs 36 limit the deck only to horizontal oscillating travel in order to further enhance particle separation on the deck surface.

The mechanical stops 38 are particularly important in achieving a desired pattern of motion on the deck surface and for causing a desired reaction in the particles to further enhance separation of particles of different densities as described in greater detail below. The stops 38 are arranged to limit rotary movement of the deck in a single direction. With riffles arranged on an inclined surface of the deck, the stops are preferably arranged so that rotary movement of the deck is limited in a direction tending to propel the relatively heavy particles upwardly and radially outwardly along the rifles.

Thus, the mechanical stops tend to cause the higher density particles to be carried further along the riffles and to thus facilitate their separation from lower density particles. During rotary oscillating movement of the deck, the higher density particles tend to continue traveling in their original direction because of their momentum. At the same time, the deck encounters the mechanical stops and rebounds in the opposite direction. The lower density particles, having less momentum, more rapidly cease traveling in their original direction and are carried by the table in the opposite direction, thus further enhancing separation between the high and low density particles.

The modulating or oscillating springs 40 are preferably arranged for interaction between the deck and the base structure similarly as the mechanical stops described above. The modulating springs further facilitate regulation of the oscillating pattern for the deck and particularly facilitate operation of the deck, for example under substantially changing loads such as when large amounts of ore are applied to the deck surface.

The modulating springs 40 principally act in effect as flexible bumpers to limit travel of the deck in a direction opposite from engagement of the deck with the mechanical stops. In this manner, the modulating springs 40 and mechanical stops 38 function in combination with the leaf springs 36 to fully modulate and achieve a desired oscillating pattern or rhythm for the concentrator deck.

The particle concentrator 20 is also contemplated for operation in either a wet or dry mode. Preferred features for operation in either of these modes are described in greater detail below but in general include variations in the low density outlet at the center of the deck and additional means for maintaining and regulating the level of water or other liquids above the surface of the deck.

In either a dry or wet mode of operation, one or more high density particle outlets are arranged on a peripheral portion of the deck with a low density particle outlet arranged in a central portion of the deck. In this regard, it is noted that if the deck is formed with an annular configuration, it may be desirable to provide more than one centrally located low density particle outlet for different circumferential portions of the deck. In one embodiment, see FIG. 8, a low density particle outlet assembly includes means for establishing and maintaining a standing head of water above the deck.

It is particularly important in connection with operation of the particle concentrator 20 in a wet mode to maintain water or liquid standing above the entire separating surface of the deck. In the prior art, water was generally allowed to flow or wash over the riffles so that the water not only affected the buoyancy of the particles but also tended to exert a flow force having a noticeable effect particularly on the low density particles.

In the present invention, it is important to avoid this washing effect so that separation of the particles occurs only because of the different specific gravities for the high and low density particles.

In the wet mode of operation for the present invention, water similarly increases buoyancy of all particles. However, because of the substantial submerging of the deck, all particles on the deck are caused to move through standing water rather than allowing the water to flow or wash over the particles. As noted above, this limits the water to merely affecting the specific gravity or buoyancy of the particles rather than exerting an undesirable flow force.

It has been found that the concentrator of the application can either be operated continuously, that is with the high density and low density particle outlets always open, or intermittently with one or both outlets closed and only opened after an extended period of operation to allow the separated particles to exit the concentrator. Particularly where very small amounts of a selected particle cut are to be recovered, such intermittent operation often permits a reduction in other particle sizes accompanying that selected cut.

A number of variations are believed obvious for the concentrator of the invention. It is noted again that operation of the concentrator is particularly dependent upon amplification of deck movement as one moves radially outwardly on the deck. Thus, changes in deck size and the drive mechanism can effect deck movement. In addition, angular pitch of the riffle means can be adjusted by changing annular inclination of the deck or angular pitch (and accordingly relative length) of one or more riffles on the deck. Similarly, the impulse movement or "stroke" of the deck can be adjusted by changing the rate of rotation, the mass of the eccentrics and, to a lesser degree, the mass of the deck itself.

Finally, before proceeding with a detailed description of the various embodiments in the figures, either high density particles or low density particles or possibly different densities of particles may form a desired out or cuts to be separated from material applied to the deck. For example, gold, silver, platinum, copper and other such high density ores can be recovered in the peripheral high density particle outlets described for the present invention. The recovering of such high density ores appears to present a major application for the particle concentrator of the present invention. Accordingly, many features of the preferred embodiments are selected for achieving very precise classification between such high density particles. For example, whereas the inverted frustoconical deck of FIGS. 1 and 4 has been found very effective for recovering high density particles as a preferred cut, an upright frustoconical deck with a high center and relatively low periphery, and possibly with an enlarged annular configuration, may be more suitable for recovering low density particles, such as coal, etc., as a preferred cut.

Materials such as coal form a relatively low density material when recovered from impurities such as pyrites, sulfites and other high density particles. Thus, many of the preferred features for the embodiments illustrated in the figures could be effectively reversed if the particle concentrator could be effectively reversed if the particle concentrator of the invention were being employed primarily to recover a low density cut of particles.

Another important or critical area of the invention concerns various riffle designs which, in combination with features of the deck, interact to achieve effective and efficient particle separation in the concentrator of the invention.

The combined features of the riffles and deck, as referred to above, include annular inclination for the deck or different portions of the deck, the angular pitch of the riffles on the deck and the height of the riffles. It is particularly important to note that these features or characteristics may be preferably varied in different portions or regions of the deck. For example, see the design of FIG. 10. Furthermore, these characteristics are also dependent upon the contemplated application for the concentrator. In particular, these characteristics or features are dependent upon the type and characteristics of ore or particles being supplied to the concentrator. Other operating parameters contemplated for the concentrator in a particular application may also cause the features of the deck and riffles to be further varied. For example, those features may be adjusted depending upon whether the concentrator is being used in a wet or dry mode of operation.

As noted above, one basic aspect of the present invention involves the production of rotary oscillating motion in the deck so that travel of high density particles is accelerated, preferably upwardly and radially outwardly, along the riffles. In connection with that aspect of the invention, the above three features of angular pitch and height for the riffles and angle of annular inclination for the deck can be adjusted either in different regions of the deck or for different applications in order to regulate either the rate of travel for selected particles along the rifles and/or to regulate the degree of separation between high density particles and the low density particles or even between multiple cuts of particles.

Yet another feature of the invention which is particularly important in achieving effective and efficient operation of the concentrator concerns its operation and configuration for recycling a middling cut of particles in order to further enhance particle separation. Such a middling cut of particles may be produced in a number of ways. For example, recycling may be produced by the supplemental riffles of FIGS. 4 and 5 or the scalping element referred to above and indicated at 248 in FIG. 10. Similarly, recycling may be initiated by refining riffles described in greater detail below and indicated at 250 in FIG. 10. Other features of the invention may also contribute to the recycling, for example, including the selection of riffle height and angular riffle pitch in order to cause a selected portion of relatively low density particles to "spill over" the riffle and move downwardly on the deck toward another riffle on which the particles can experience further separation and classification.

In any event, the recycling of particles from one riffle to a lower riffle causes the middling cut to be recycled one or more times. The distance traveled by the particles about the deck is multiplied each time the particles are recycled in order to allow more accurate separation or classification of a desired particle cut or cuts.

Recycling is preferably accomplished by a combination of principal feed riffles and supplemental recycling riffles illustrated in both configurations or designs of FIGS. 4 and 5. In each of those designs, it is particularly important that generally constant spacing be maintained for the supplemental riffles, relative both to each other and to the principal feed riffles in order to achieve recycling in a manner described in greater detail below. In any event, while the supplemental riffles accomplish a function of recycling and concentrating of a selected cut of particles, the principal feed riffles are essential in that they provide communication for the selected cut of particles with the high density particle outlets or outlet at the periphery of the deck.

The ability of the invention to recycle particles as discussed above is particularly important when considered relative to the prior art. In the prior art, particularly on shaker tables or tables adapted for linear oscillation, a middling cut of particles could also be removed in one fashion or another. However, once the middling cut was removed from the table, it was then commonly recycled to a separate concentrator or table in order to achieve further refinement or recycling which, as noted above, is an automatic feature of the present invention.

Automatic recycling of a middling cut of particles is dependent in part upon the arrangement of spiral or angularly inclined riffles allowing spill over of particles as described above. In addition, the effective and efficient operation of a particle concentrator according to the present invention depends on the other features of the invention as summarized above in combination with the automatic recycling feature.

The rotary oscillating motion produced in the deck functions in combination with riffle features of angular pitch and height as well as deck features such as annular inclination to accomplish at least two important purposes. Initially, continued rotary oscillation of the deck causes higher density particles to settle closer to the deck with lower density particles being carried upwardly from the deck by the higher density particles. This effect is referred to as "vertical classification" and facilitates particle separation either by allowing the low density particles to spill over the riffles or, for example, to allow a portion of the lower density particles to be removed from the riffles either by scalper elements or refining riffles as noted above and described in greater detail below.

FIGS. 4 and 5, described in greater detail below, illustrate riffle patterns preferably contemplated for arrangement upon concentrator decks of generally constant annular inclination. Those riffle patterns are both preferably divided into a number of regions or zones as described in greater detail below with reference to FIGS. 6 and 7.

FIG. 10 illustrates yet another riffle pattern for a concentrator deck 22' which is preferably of varying annular inclination while being divided into three regions including a settling region 242 formed on a radially inward portion of the deck generally adjacent the low density particle outlet, a concentrating region 244 arranged radially outwardly and adjacent the settling region and a refining region 246 optionally formed radially outwardly of the concentrating region and preferably closely adjacent the high density particle outlet or outlets 28'.

Scalping elements 248 and refining riffles 250 are also illustrated in FIG. 10 and provide means for recycling a middling cut of particles in order to substantially enhance particle separation as discussed in greater detail below.

As noted above, the features of angular inclination and height for the riffles and vertical inclination for the deck are particularly important in achieving the desired functions in these three regions. Initially, the setting area surrounds the low density particle outlet and facilitates initial separation or vertical classification between high density and low density portions of ore or other particles applies to the deck. Thus, the settling area also provides a preferred location for feeding additional ore or particles to the deck. In the settling area of the deck, the riffles are preferably relatively high and of reduced angular inclination with the deck also having a low degree of vertical inclination, possibly even being horizontal in order to better facilitate the desired function for the settling region.

Once initial separation or vertical classification of the particles is accomplished in the settling region, the higher density particles are carried radially outwardly and preferably upwardly at least on the inverted frustoconical deck, riffle means as also referred to as master riffles or carriers to the concentrating region. In the concentrating region, the higher density particles experience further classification and recycling in order to carry a closely controlled out of high density particles outwardly toward either the refining region or a high density particle outlet. Thus, in the concentrating region, the height of the riffles is reduced compared to the settling region and the angular inclination of the riffles may be increased in order to produce additional separation or spill over of particles from the riffles. The degree of vertical inclination of the deck may also be increased in the concentrating region for the same purpose.

The scalping elements 248 are also a preferred means for causing recycling of particles, preferably intermediate either the settling region 242 and concentrating region 244 or even between the concentrating region 244 and refining region 246.

In the refining region of the deck, very precise classification and separation of a small cut of high density particles is achieved. Thus, the height of the riffles is again reduced and the angular inclination of the riffles may be reduced even to zero so that the riffles are essentially concentric in order to further facilitate vertical classification of particles.

The refining riffles 250 preferably provide a final recycling means for transporting only a very small cut of highest density particles toward the high density particle outlet while recycling a middling cut of high density particles to the concentrating region 244 in order to even further facilitate particle separation on the concentrator.

Numerical ranges of height and angular inclination for the riffles and vertical inclination for the deck are set forth below for each of the various regions of the deck surface.

Other features of the invention, in addition to those summarized above, will be apparently important to operation of the concentrator from the following detailed description of the preferred embodiments in the drawing figures. However, the preceding summary emphasizes the selected important features in the particle concentrators of the present invention.

Construction of the particle concentrator 20 is described below having reference primarily to FIGS. 1–3. Referring to those figures, the concentrator 20 includes a base structure 52 and an upper support carriage or assembly 54 to which the deck 22 is secured. The upper support carriage 54 and accordingly the deck 22 are supported or suspended relative to the base structure 52 by the plurality of vertically arranged leaf springs 36. Referring particularly to FIGS. 2 and 3, the vertical leaf springs 36 are secured respectively to the upper support carriage 54 and the base structure 52 by brackets 56. With the leaf springs 36 thus being secured between the base structure and the deck 22 by means of the upper support carriage 54, they are effective to accomplish the three basic functions summarized above.

Mechanical stop assemblies 38 are positioned on opposite sides of the base structure 52 as illustrated in FIG. 3 for achieving more balanced interaction with the deck 22 through the upper support carriage 54.

Each of the mechanical stop assemblies 38 comprises a fabricated frame 58 secured to the base structure 52 and rigidly supporting a mechanical stop pad 60 in opposition and slightly spaced apart relation to a stop pad 62 secured to the upper support carriage 54. The stop pad 60 is preferably adjustable upon the fabricated frame 58 in order to better adapt the particle concentrator 20 for use in different applications and, for example, with different ores or particle combinations to be separated. Thus, the spacing between the stop pads 60 and 62 may be selected to better facilitate proper control over rotary oscillation of the deck 22.

Referring momentarily to FIGS. 4, 5 and 10, the riffles angle outwardly on the deck in a clockwise pattern. At the same time, the stop pads 60 and 62 are arranged for abutting engagement in order to limit oscillating travel of the deck in a clockwise direction. Thus, interaction of the mechanical stops 38 with the drive mechanism 32 serves to propel higher density particles upwardly and outwardly along the riffles 30 as discussed in greater detail above.

Modulating spring assemblies 40 are also arranged on opposite sides of the base structure 52 for similarly assuring balanced modulation in the oscillating travel of the deck. Each of the modulating spring assemblies 40 comprises a fabricated frame 64 secured to the base structure 52. Opposing spring mounts 64A and 54A are respectively arranged on the fabricated frame 64 and the upper support carriage 54 for capturing a modulating spring 70 which thus serves to regulate modulation or rhythm of the deck as also described above.

The drive mechanism 32 is best illustrated in FIGS. 2 and 3 and includes a shaft 72 extending through the axis of rotation 26 for the deck 22 (see FIG. 1) and supported by self-aligning bearings 74. The bearings 74 are mounted on the upper support carriage 54 by brackets 76.

Figure 6:
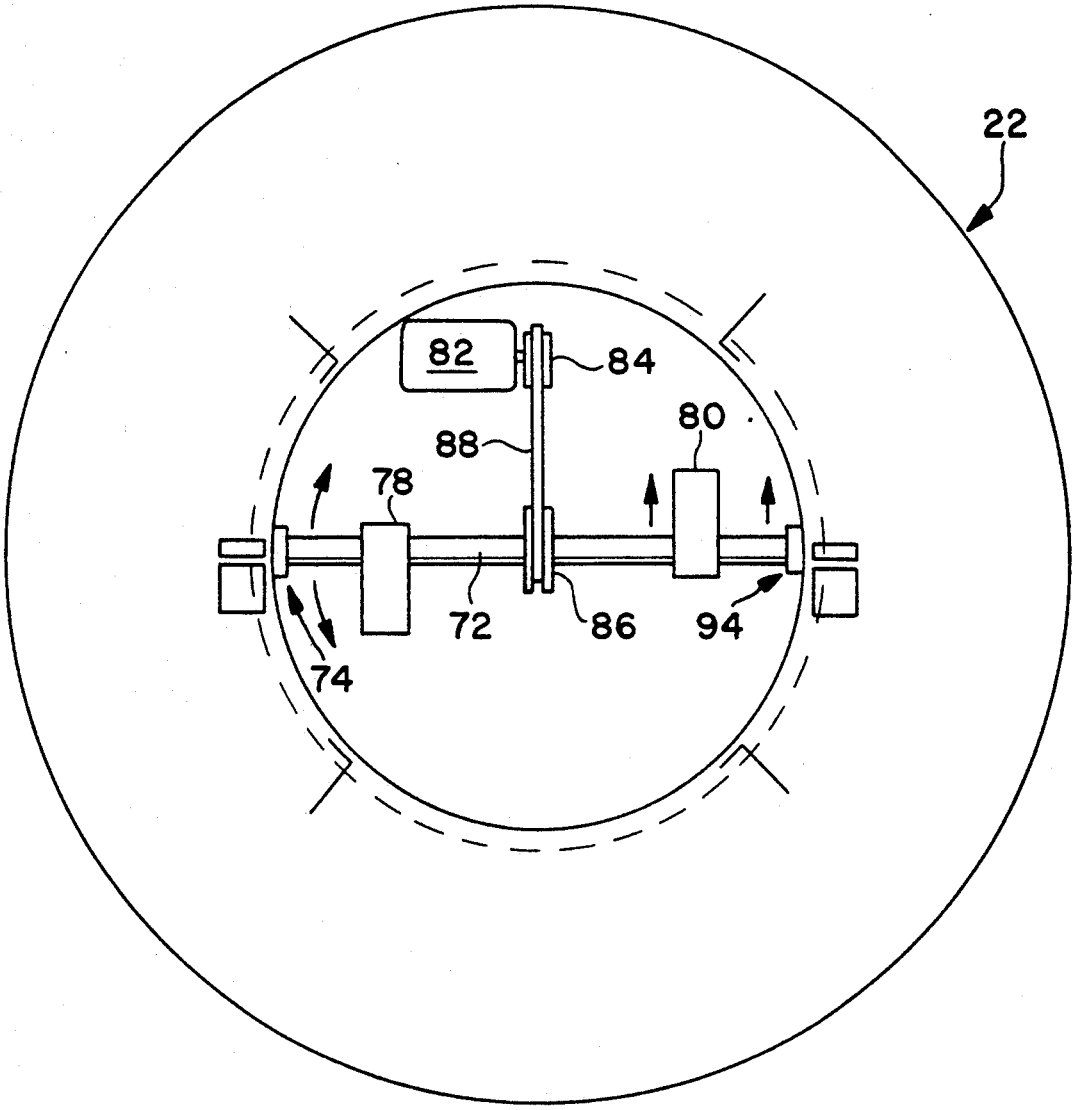
FIG. 6 is a schematic plan view of the concentrator deck and drive mechanism (arranged under the concentrator deck) as also illustrated in FIGS. 1–3.

Eccentric masses 78 and 80 are arranged on generally opposite end portions of the shaft 72. Referring also to FIGS. 2 and 6, the eccentric masses 78 and 80 are preferably arranged adjacent radial portions of the deck for best achieving the desired rotary oscillating motion in the deck. The eccentric masses 78 and 80 are also preferably adjustable upon the shaft 72, again for permitting adaptation of the concentrator for use in different applications and with different combinations of ores or other particles.

As is illustrated in FIG. 2, the eccentric masses 78 and 80 are arranged in offset relation to each other in order to produce a desired oscillating effect within the upper support carriage 54 and the deck 22.

The eccentric masses 78 and 80 are driven in rotation upon the shaft 72 by a motor 82 mounted upon the base structure 52 (also see FIG. 3). A drive pulley 84 on the motor 82 is coupled with a pulley 86 secured to the shaft 72 by means of a flexible drive belt 88 to assure operation of the drive mechanism 32 by the motor 82 during relative oscillation between the upper support carriage 54 and the base structure 52.

Figure 11:
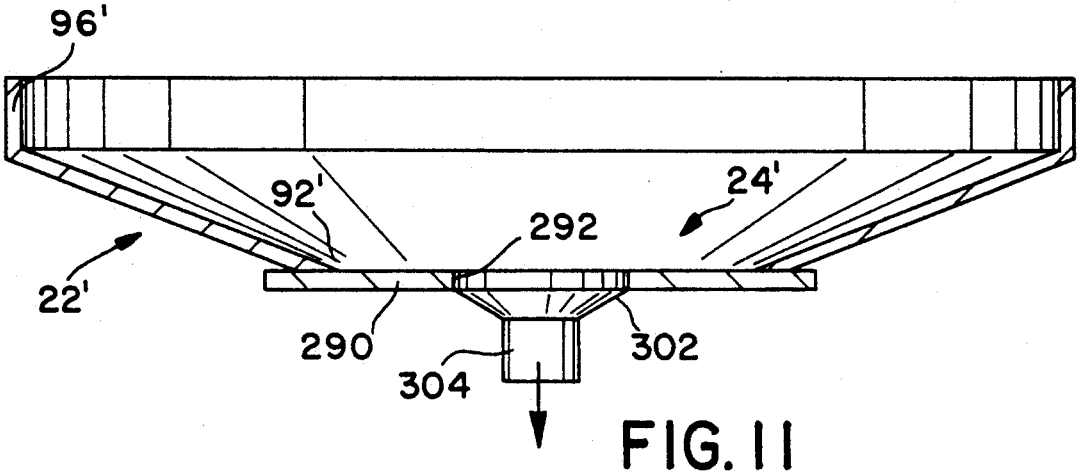
FIG. 11 is a fragmentary side view in elevation, with parts in section, of a centrally arranged low density particle outlet contemplated for use with the concentrator deck of FIG. 10 and the particle concentrator of FIGS. 1–3 in a dry mode of operation.
Figure 12:
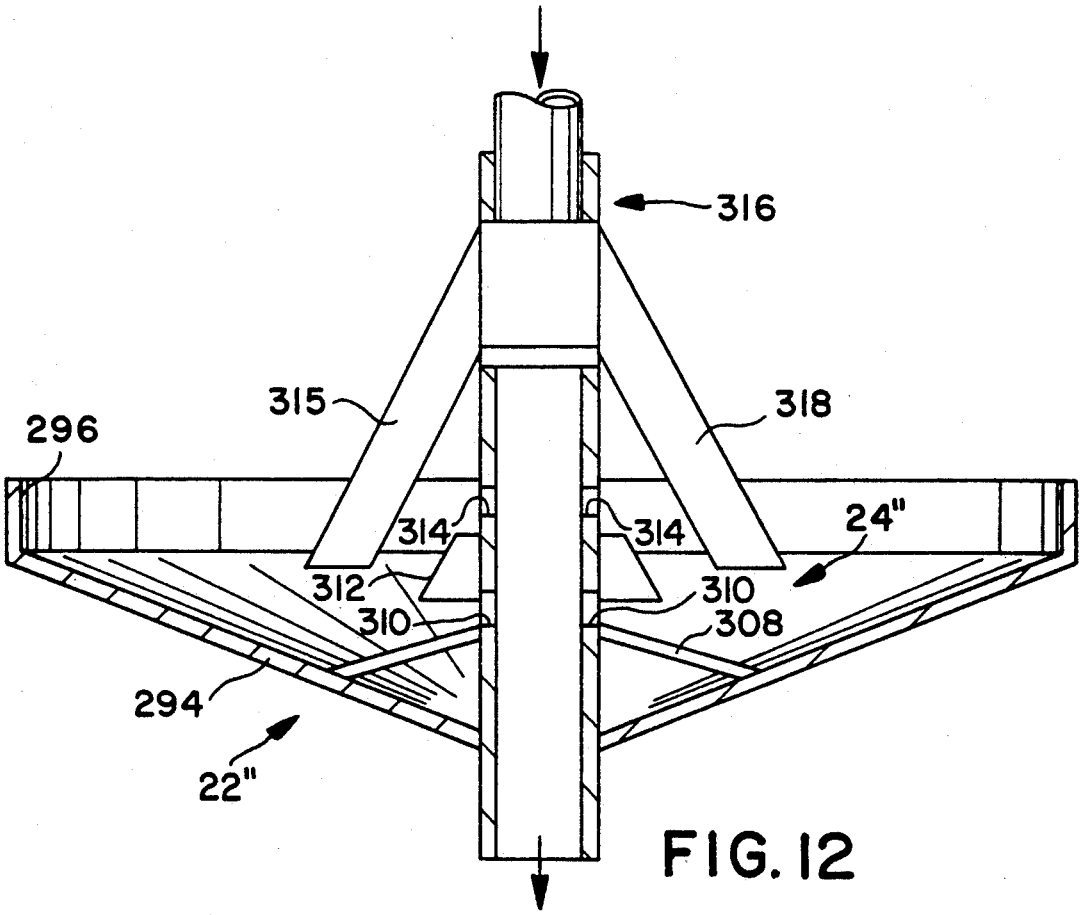
FIG. 12 is a similar fragmentary side view in elevation, with parts in section, of a centrally arranged low density particle outlet including a standpipe for use with the concentrator deck of FIG. 10 and the particle concentrator of FIGS. 1–3, preferably in a wet mode of operation with the deck being submerged under standing water or liquid.

The deck 22 may be formed in a number of ways to achieve the basic functions described above. However, a preferred manner of construction for the deck 22 is illustrated in FIG. 1 to achieve both the degree of vertical inclination in its various surface portions and also to facilitate mounting an interconnection of the deck 22 with the upper support carriage 54. Other deck configurations are illustrated in FIGS. 11 and 12.

The deck 22 is formed with a central opening 92 for receiving the low density particle outlet 24. The deck 22 is also readily secured to the upper support carriage 54, for example, by welding, bolts, etc.

An annular frustoconical plate 94 is secured to the carriage 54 in inverted relation to provide desired vertical inclination in selected portions of the deck 22 in accordance with the features summarized above and as described in greater detail below. A cylindrical element 96 is secured to the peripheral portion of the frustoconical plate 94 to form a vertical flange on the deck 22. The flange 96 is particularly important for use of the particle concentrator 20 in a wet mode of operation. The flange 96 then serves to contain the water or other liquid at a substantial depth above the entire separating surface of the deck. As noted above, the deck 22 is also provided with a low density particle outlet 24 centrally arranged on or adjacent the axis of rotation 26. One high density particle outlet 28 is also illustrated on a peripheral portion of the deck 22 and more specifically on a peripheral portion of the frustoconical plate 94. Particle output from both the low density and high density particle outlets 24 and 28 may be collected from the concentrator by any desired means, a preferred arrangement for the low density particle outlet 24 being described elsewhere herein.

With the particle concentrator 20 being constructed in the manner described above and illustrated in FIGS. 1–3, the riffles 30 are arranged or formed on the surface of the deck 22 preferably in a manner illustrated in FIGS. 4 or 5. Here again, it is particularly important to note that the configuration of the riffles is particularly dependent upon the specific contemplated application for the concentrator. Accordingly, the riffle arrangements described below with reference to FIGS. 4, 5 and 10 are merely illustrative of preferred riffle configurations contemplated for the concentrator 20 of the invention. More specifically, the riffle configurations of those figures are specifically contemplated for use of the concentrator in applications where small very high density cuts of particles or ore are to be separated and recovered. The riffle configuration according to the present invention would be substantially modified if, for example, the concentrator were being operated to separate and recover an intermediate density cut of particles or a relatively low density cut of particles.

The working surface of one embodiment of the concentrator deck 22 is illustrated in FIG. 4. Referring also to FIG. 1, the deck 22 is formed as an inverted frustoconical element having an annular inclination of approximately 12°14 15°. The annular inclination of the deck 22 is better illustrated in FIG. 8. The low density particle outlet 24 is formed as an additional inverted frustoconical element having a substantially greater inclination than the deck 24 (also see FIG. 8).

The riffles 30 include four principal feed riffles 102, 104, 106 and 108 having their origins immediately adjacent the low density outlet 24 spaced apart from each other approximately 90°. Each of the principal feed riffles 102–108 has a pitch along the deck surface 22 formed as a spiral so that each of the principal feed riffles rises to the periphery or outer portion 110 of the deck. Each of the spirals for the principal feed riffles has an extent of about 360°. Thus each of the principal feed riffles approaches the outer periphery 110 of the deck generally in radial alignment with its origin adjacent the low density outlet 24. Thereafter, each of the principal feed riffles has a 90° segment of generally uniform radius continuing approximately 90° about the periphery 110 of the deck to form a refining zone described in greater detail below. The constant radius portions of the respective principal feed riffles are indicated at 102A, 104A, 106A and 108A.

The specific number of principal feed riffles may be varied depending upon the particular application and possibly other design considerations. For example, the four principal feed riffles illustrated in FIG. 4 could be replaced by three principal feed riffles spaced 120° apart or six principal feed riffles spaced approximately 60° apart. With the general design illustrated in FIG. 4, the constant radius portion for the principal riffles is determined by their number. For example, with three principal feed riffles, each of them could have a constant radius refining portion of 120°.

Figure 8A:
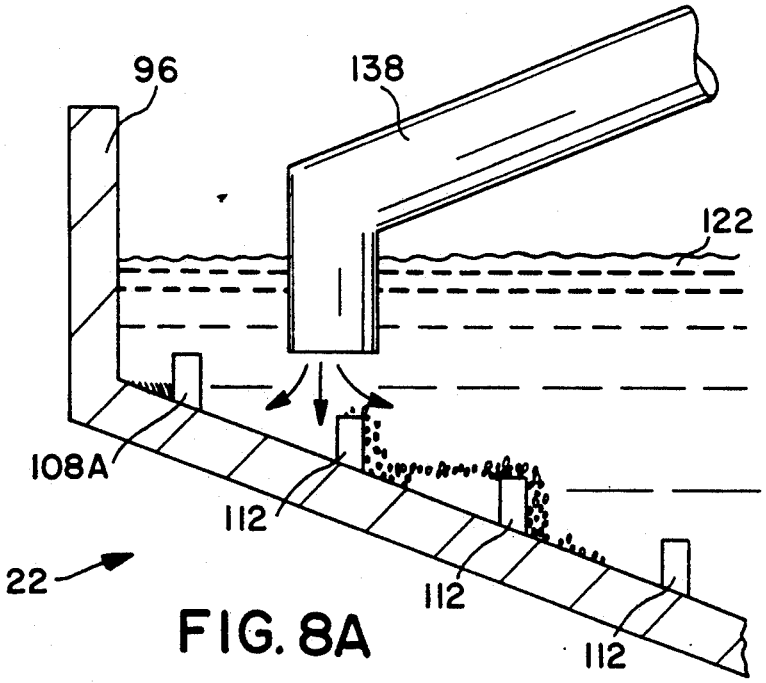
FIG. 8A is a fragmentary cross sectional view similar to FIG. 8 to better illustrate riffle height and spacing in a riffle design such as that illustrated in either of FIGS. 4 or 5 for example.

Furthermore, as may be seen in greater detail in FIG. 8, supplemental riffles 112 are arranged in angular or spiral relation intermediate the principal feed riffles 102–108. The supplemental riffles 112 serve a refining function. Referring also to FIG. 8, the supplemental riffles are generally arranged with uniform spacing from each other and from the principal riffles. Referring also to FIG. 8A, the riffles have an overall height as illustrated of approximately ⅜ inches. The supplemental riffles 112 are spaced apart from the principal feed riffles and from each other approximately 2 inches so that the top of each riffle is about the same elevation, preferably somewhat lower, than the base of the next adjacent riffle, either principal or supplemental, arranged upwardly on the deck 22. As illustrated in FIG. 8A, this spacing assures that particles flowing over the top of each riffle come in engagement with the surface of the deck 22 as they move downwardly on the deck surface toward the next adjacent riffle. This assures that the particles have an opportunity to remain in contact with the deck surface rather than being carried on the top of other particles and flowing over the top of the next adjacent riffle.

Another riffle design is illustrated in FIG. 5 including substantially the same components as FIG. 4. Accordingly, primed numerical labels are employed in FIG. 5 to indicate components corresponding to those in FIG. 4. The only difference in FIG. 5 over FIG. 4 is that the principal riffles extend 180° in a spiral configuration so that they approach the outer periphery 110, of the deck in 180° spaced apart relation from their origins adjacent the low density particle outlet 24'. Thereafter, each of the principal riffles again has a constant radius segment of about 90° as a refining zone similar to that described in FIG. 4.

In both FIG. 4 and FIG. 5, at least one of the constant radius sections for the principal feed riffles communicates with one or more high density particle outlets in the periphery 110. Thus, high density particles can be carried to the high density particle outlets 128 only by the principal feed riffles. This assures that the supplemental riffles 112 or 112' serve only a refining function as described above.

The surface of the concentrator deck may be divided into different regions.

FIGS. 4 and 5 in combination illustrate a variety of riffle patterns possible for the present invention. Where the principal feed riffles of FIGS. 4 and 5 have a spiral extent of 360° and 180° respectively, it is also obvious that different designs are possible with other spiral configurations. For example, similar riffle patterns are possible with the principal feed riffles having a spiral extent of either 90°, 270° or otherwise. It is of course obvious that the particular riffle design is to be selected based upon the contemplated application for the concentrator and other design criteria.

FIG. 6 illustrates the arrangement of the frustoconical deck 22 relative to the drive elements described elsewhere with respect to FIGS. 1–3. As may be seen in that figure, substantially all portions of the frustoconical deck 22 are radially spaced substantially apart from the axis of rotation 26 in order to assure that a substantial momentum is imparted to particles on all portions of the deck 22.

Figure 7:
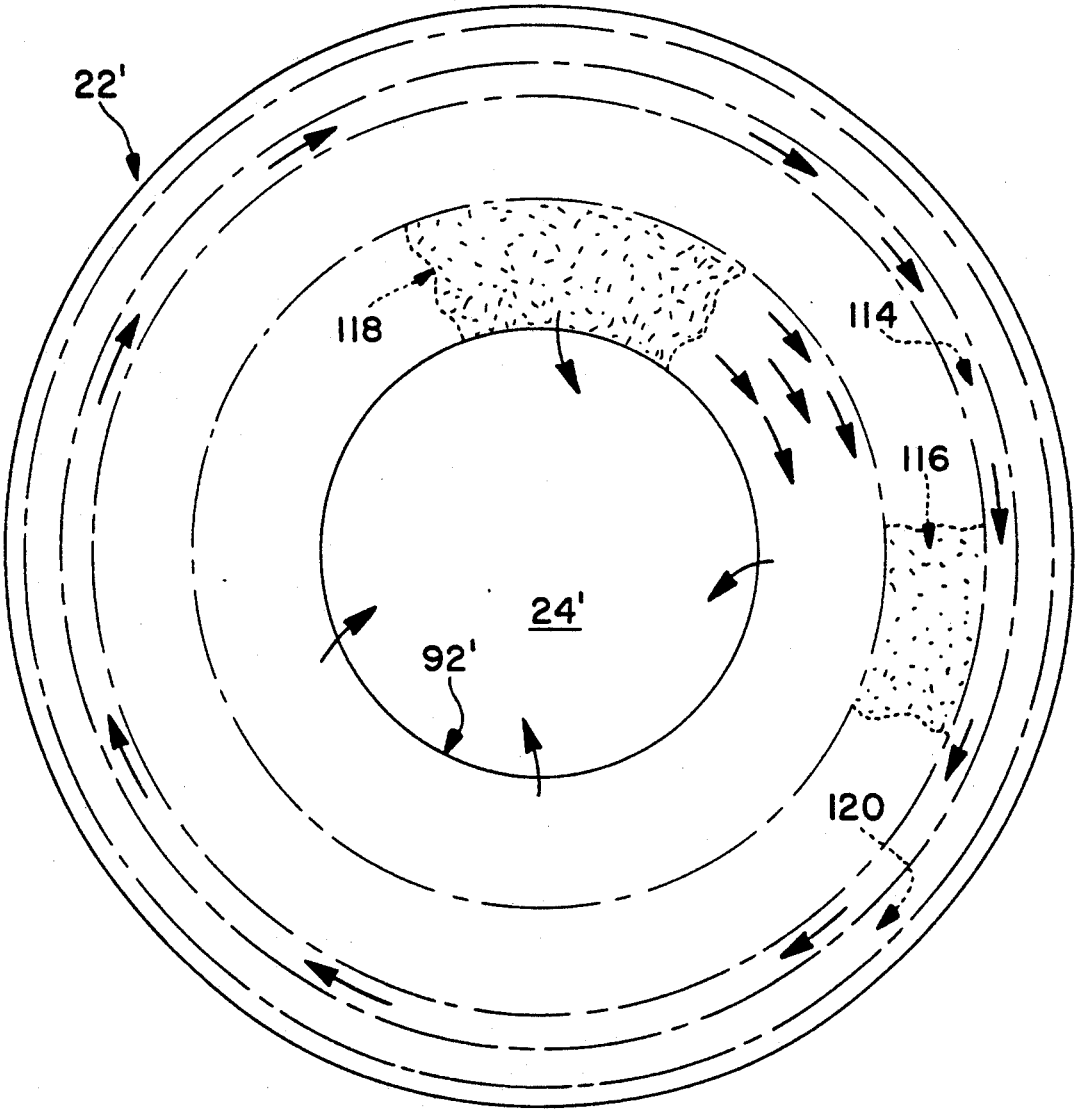
FIG. 7 is a similar schematic plan view of the concentrator deck along illustrating various regions upon the concentrator deck, with the concentrator including features as illustrated in FIGS. 1–4, 8 and 8A.

Referring also to FIG. 7, it is particularly contemplated that particles of varying density are fed onto the deck 22' in a feed zone 114 spaced just radially inwardly from the outer periphery 110 of the deck 22'. A feed assembly for delivering particles in that zone is described in greater detail below. Furthermore, it is contemplated that the concentrator deck 22'of FIG. 7 may be operated either dry or preferably under a head of standing water as described below and illustrated in greater detail in FIG. 8. In any event, as the particles encounter the surface of the deck 22' along the feed zone 114, they immediately tend to flow radially downwardly or inwardly toward the low density particle outlet 24. At the same time, they experience vertical classification as described above so that the relatively heavier particles tend to approach the surface of the deck while relatively lighter particles glide thereupon.

As the particles interact with each other, deck 22 and the riffles 30, they tend to form a concentrating main zone extending generally from the feed zone radially inwardly toward the low density outlet 24. The concentrating main zone is indicated at 116. A radially inner portion of the deck 22' then forms a final reclaiming zone 118. Because of the design of the deck 22' and the riffles 30, relatively heavier particles tend to approach the surface of the deck and remain in the concentrating main zone 116. With additional separation, the highest density particles then approach a final concentrate or refining zone 120 generally between the feed zone 114 and the outer periphery 110 of the deck. Generally, only the highest density particles approaching a density selected for removal by means of the high density outlet 128 are in the refining zone 120. Relatively low density particles tend to immediately flow through the final reclaiming zone 118 toward the low density outlet 124. However, because of the recycling supplemental riffles, the concentrator of the present invention provides greatly enhanced separation and recovery of the selected cut, here high density particles, because of the deck design, the riffle design and the operation of the concentrator as described below with references to FIGS. 1–3.

As noted above, a movable feed assembly for use with the riffle configuration of FIG. 4 or FIG. 5 is illustrated in FIGS. 8 and 9. Referring to those figures, it is noted again that the concentrator deck 22 is formed as an annulus having an annular inclination of about 12°–15°. The flange 96 forms an enclosure around deck 22 so that it can be filled with water or other liquid to a level generally indicated at 122. The low density particle outlet 24 includes an inverted discharge cone 124 having a substantially steeper annular inclination than the concentrator deck 22. Preferably, the discharge cone 124 is integrally formed together with the concentrator deck 22. A low density particle discharge assembly 126 is then adapted to be threaded into a central opening 128 in the discharge cone 124. The discharge assembly 126 is described in greater detail below with additional reference to FIG. 8B.

A feed assembly is indicated at 130 and includes a circular feeder track 132 mounted upon the concentrator deck generally at the intersection between the concentrator deck 22 and discharge cone 124. As illustrated in FIG. 8, the feeder track 132 is mounted upon the concentrator deck by means of support legs 134 circumferentially arranged about the circular feeder track.

A spider-like feed unit 136 includes a plurality, preferably three, tubular outlets 138 extending radially outwardly from a receiving port or hopper 140. Referring also to FIG. 7, the outer ends of the outlets 138 terminate above the feed zone 114 so that a particle mixture introduced into the receiving port 140 is delivered onto an appropriate portion of the concentrator deck as described above.

Feeder legs 144 extending downwardly from the feed unit 136 have elastomeric pads 146 at their lower ends which rest upon the circular feeder track 132. At the same time, a centering element 148 is interconnected between the feeder legs to assure that the entire feed unit 136 remains centered with respect to the concentrator deck and particularly with respect to the circular feeder track 132.

With the concentrator deck being operated in rotary oscillation as described above, interaction of the deck with the mechanical stop means also imparts motion to the feed unit 136 so that it tends to rotate relative to the concentrator deck while being supported upon the circular track 132. Thus, the particle mixture from the tubular outlets 138 is distributed more uniformly about the periphery or tne concentrating deck in the feed zone indicated at 114 in FIG. 7.

Figure 8B:
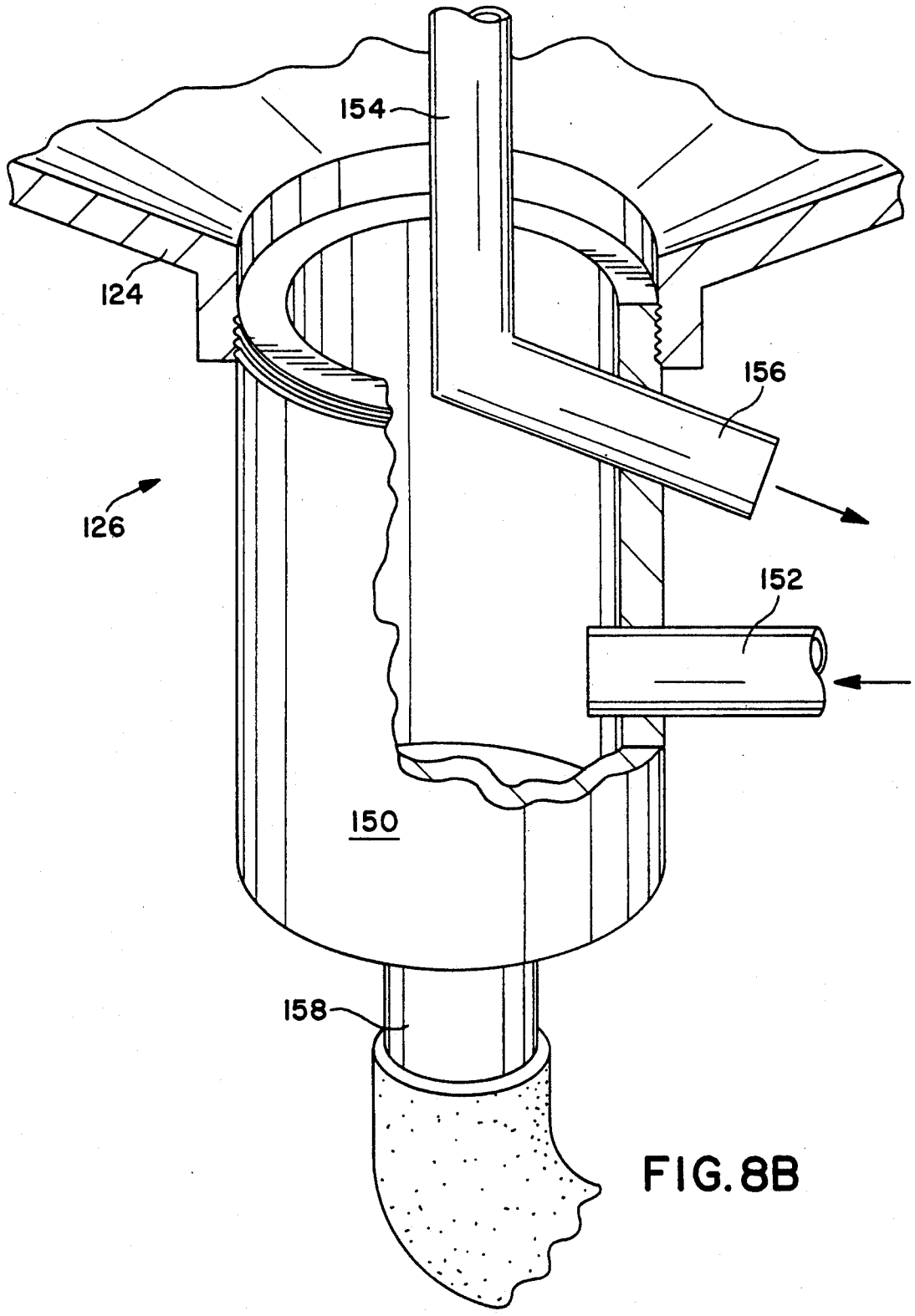
FIG. 8B is a fragmentary section of the deck of FIG. 8 to better illustrate a low density particle outlet adapted for maintaining a standing head of water above the concentrator deck.

Referring also to FIG. 8B, the discharge assembly 126 includes a relatively large vertical collar 150 extending downwardly from the central opening 128 in the discharge cone 124. Water to fill the concentrator deck to the level 122 is introduced through a sidearm 152 in the vertical collar 150. Thus, when the concentrator deck is filled with water, water introduced from the sidearm 152 tends to flow upwardly against pressure established by the head of standing water on the deck. At the same time, a standpipe 154 extends vertically upwardly from the collar 150 and terminates generally adjacent the selected water level 122. The standpipe 154 also has a branched outlet 156 in the collar 150 so that water overflowing the top of the standpipe 154 can exit the concentrator deck in order to maintain the water level 122.

The discharge assembly 126 also has a discharge outlet 158 formed at the bottom of the vertical collar 150. Thus, as relatively low density particles move radially inwardly on the concentrator deck 22, they flow down the discharge cone 124 and into the vertical collar 150 counter to input water from the sidearm 152. It is noted again that the standing head of water on the concentrator deck forms a relatively quite zone in the vertical collar 150 so that the low density particles can flow downwardly toward the discharge outlet 158 while input water rises upwardly toward the concentrator deck from the sidearm 152.

The discharge outlet 158 is preferably sized in order to permit the low density particles and a small portion of water from the concentrator deck to flow outwardly through the outlet to be collected and further processed in a manner outside the scope of the present invention.

Other options are also possible for handling low density tailings discharged from the outlet 158. For example, the discharge outlet 158, as described above, provides a gravity system for allowing the low density particles to exit the concentrator deck. Other options include the use of siphon lines or gravity fall through a central inverted cone into a dewatering sand screw extending above the static water level of the concentrator deck for removing the low density particles form water exiting the low density outlet. These additional options are noted only by way of example and are not illustrated herein.

Referring again to FIG. 10, the separating surface of the deck 22' is divided into a settling region 242 adjacent the centrally arranged low density particle outlet 24', a concentrating region 244 radially outwardly of and adjacent the settling region and a refining region 246 radially outwardly of the concentrating region and adjacent or including the high density particle outlet 28', as described above.

The concentrating region 244 and the refining region 246 are formed on the frustoconical plate 94' and thus both have a vertical inclination of about 12°–15°.

More basically the vertical inclination of the deck in the settling region may typically vary from about 0° up to about 3° or 5° with vertical inclination in the concentrating region 244 and refining region 246 typically varying from about 3° or 5° up to as much as 20°.

The vertical inclination of the deck 22' and the characteristics of the riffles 30' as described below are both based upon the deck 22' having an overall diameter of about 6 feet, the opening 92' for receiving the low density particle outlet 24' having a diameter of about 15 inches. The inner diameter of the frustoconical plate 94' and accordingly the outer diameter of the exposed portion of the flat plate 290 (also see FIG. 11) is about 24 inches. The vertically angled surface of the frustoconical plate 94' thus forms the remainder of the deck 22'.

A riffle pattern illustrated in FIG. 10 is contemplated for use preferably in a dry mode with a concentrator deck constructed as illustrated in FIGURE 11 or in a wet mode as illustrated in FIG. 12. Accordingly, deck constructions for those two figures are described immediately below prior to a description of the riffle pattern in FIG. 10.

Referring now to FIG. 11, one embodiment of a low density particle outlet 24' is illustrated preferably for use with the particle concentrator 20' of FIG. 10 in a dry mode of operation. The low density outlet 24' includes a relatively simple combination of a funnel-shaped element 302 secured in the opening 292 of a flat plate 290 with a cylindrical element or tube 304 extending downwardly from the funnel-shaped member 302 for conveying low density particles away from the deck surface 22'. As noted above, any appropriate means (not shown) could be employed for receiving the low density particles from the outlet 24' and conveying them away from the concentrator as desired.

Another low density particle outlet 24'' is illustrated in FIG. 12, preferably for use with the particle concentrator 20' of FIG. 10 in a wet mode of operation. In a embodiment of FIG. 12, the frustoconical plate 294 extends radially inwardly for engagement with a vertical standpipe 306 which also forms an outlet through which the low density particles pass away from the deck 22''. An additional frustoconical plate 308 of relatively small diameter is arranged in upright relation and extends between the surface of the frustoconical plate 94' and outlet passages 310 formed in the standpipe 306 for receiving low density particles with some water or other liquid from the surface of the deck. Except for the modification of the frustoconical plate 308, the deck 22'' in FIG. 12 is configured with riffles similar to those described above and operates in substantially the same manner as described above except with the deck being submerged under water or other liquid. An adjustable collar 312 is also vertically adjustable upon the standpipe 106 for regulating or adjusting the outlet passages 310. Overflow passages 314 are formed in an upper portion of the standpipe generally below the upper edge of the flange 296 in order to control the level of water standing in the deck 22''. In operation, additional means (not shown) are provided for supplying make-up water to the surface of the deck 22'' so that as some water flows out of the overflow passages 314 and the outlet passages 310 with the low density particles, water is maintained on the deck at about the level of the overflow passages 314. As noted above, water is preferably maintained at a level substantially above all surface portions of the deck in order to better facilitate particle separation and classification.

A top portion of the standpipe 306 forms a feed inlet 316 for receiving ore or other particles with branched outlets 318 conveying the particles toward the surface of the deck, preferably below the water level established by the overflow passages 314.

In the embodiment of FIG. 10, the riffles 30' comprise master or carrier riffles 198 extending through the settling region 242 and at least a portion of the concentrating region 244. Four master riffles 198 are evenly spaced about the deck 22'. Three of the master riffles 198 terminate in the concentrating region 244 with only a single riffle 200 forming an extension of one master riffle 198. The single riffle 200 extends into the refining region 246 and toward the high density particle outlet 28'. Preferably, the single riffle 200 is generally concentric with an angular inclination approaching zero so that maximum vertical classification of a very high density cut of particles can take place as the particles travel circumferentially upon the concentric riffle 200.

Recycling of a middling cut of particles is achieved both between the settling region 242 and concentrating region 244 by means of one or more scalping elements such as that indicated at 248 and between the refining region 246 and the high density particle outlet 28' by means of the refining riffles indicated at 250.

In the settling region 242, the master riffles 198 are formed within an angular range of about 3°–10°. The height of the master riffles 198 in the settling region are substantial, varying for example from about one half inch to one inch (½ to 1 inch). More preferably, the master riffles 198 have an angular configuration of about 5° and a height of about one half (½) inch in the settling region.

In the concentrating region, the master riffles preferably have an angular inclination in the range of about 8° to 20°, more preferably about 10° to 15° and most preferably about 12°. The height of the riffles in the concentrating region varies, for example, from about three sixteenth (3/16) of an inch to about one half (½) inch, the master riffles in the concentrating region preferably varying over that range from the radially outward portion of the concentrating region to the radially inward portion of the concentrating region.

As noted above, the angular inclination of the concentric riffle 200 in the refining region 246 is very slight, generally in the range of about 1° to 5°. More preferably, as illustrated in FIG. 10, the angular inclination of the riffle 200 varies from about 5° where it leaves the concentrating region 44 with a substantial circumferential portion of the riffle 200 being concentric (that is, with 0° inclination) to achieve maximum vertical classification as described above.

As noted above, one or more scalping elements such as that indicated at 248 can be employed to facilitate recycling as described above. Preferably, each scalping element 248 is formed by a pin secured to the surface of the deck 22' radially outwardly from a selected portion of a master riffle 198. From the point of connection with the deck, the pin or scalping element 248 is angled radially inwardly and in a clockwise direction to overlie and abut the top of the master riffle 198. In this manner, the scalping element or pin 248 forms a limited passage above the master riffle 198 so that only a selected high density particle cut can pass beneath the scalping element 248. The remaining particles are "scalped" or caused to spill over the master riffle 198 to which the scalping element is attached. Those remaining particles are thus recycled to a lower riffle on the deck 22' so that they will be circulated about the deck again by a lower riffle to further enhance particle separation on the concentrator.

A refining riffle or set of riffles 250 is preferably associated with each riffle 200 in the refining region and with each high density particle outlet 28'. As illustrated in FIG. 10, a pair of slightly spaced apart refining riffles 250 are angularly positioned upon the deck surface at the end of a concentric portion of the riffle 200. the refining riffles angle upwardly and in clockwise fashion on the deck surface to intercept classified particles passing from the end of the concentric riffle 200. In this manner, only a very high density cut of particles is conveyed radially outwardly on the refining riffles 250 toward the high density outlet 28'. The remaining particles spill over the refining riffles 250 and pass to a lower riffle, preferably in the concentrating region 244 for achieving further recycling and further enhancing particle separation in accordance with the present invention.

Other recycling means could be employed in place of the scalping elements 248 and the refining riffles 250 for achieving the important recycling function of the present invention.

Figure 14:
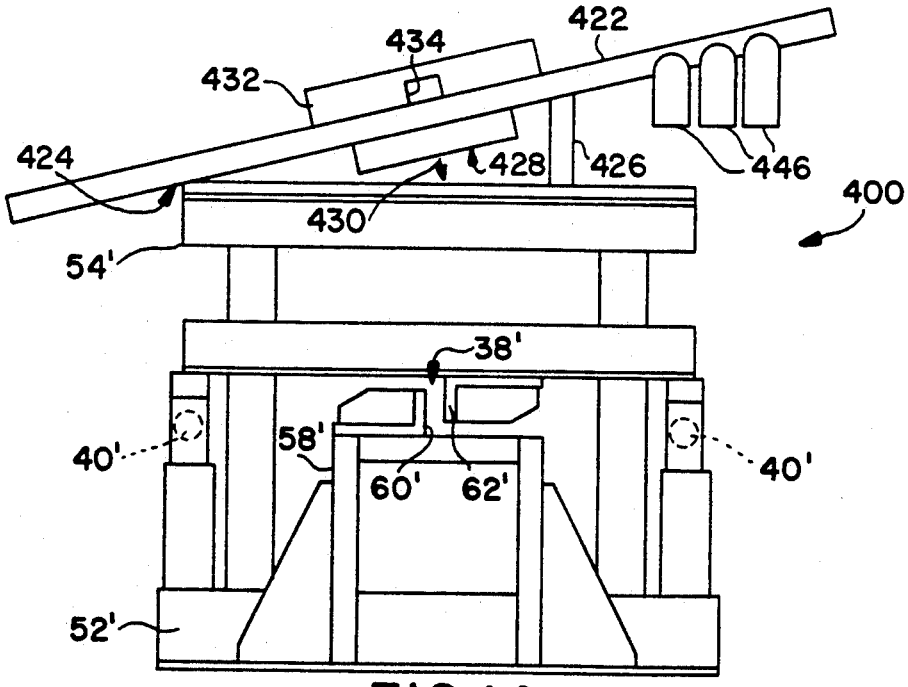
FIG. 14 is a plan view of the particle concentrator of FIG. 13 while also illustrating one possible variation of a riffle design on its deck.

Another embodiment of a particle concentrator is generally indicated at 400 in FIGS. 13 and 14. In this embodiment, all of the components for the concentrator other than the deck are substantially similar to those described above for the embodiment of FIGS. 1–4. Accordingly, similar primed numerals are employed to indicate the corresponding elements in FIGS. 13 and 14.

In FIG. 13, a flat deck 422 is arranged upon the upper support carriage 54'. The flat deck 422 could be arranged with its axis of rotation in a vertical position similar to that described above for the deck 22 of FIGS. 1–3. However, the flat deck 422 is preferably tilted or inclined so that its entire surface is arranged at a common angle of vertical inclination. FOr example, the deck 422 can be arranged at an angle of approximately 0° to 20°, more preferably about 10° to 15° and most preferably about 12°.

To facilitate angular adjustment of the deck 422, it is preferably pivoted at 424 to the upper support carriage 54' with an adjustable element 426 on an opposite portion of the upper support carriage 54' from the pivot joint 424 for raising the deck 422 into its inclined position.

With the deck 422 positioned in vertical inclination as described above, its surface is configured as better illustrated in FIG. 10 to facilitate particle separation or classification in a manner similar to that described above. In the embodiment of FIGS. 13 and 14, a low density particle outlet 428 is centrally arranged on the deck 422 generally at or adjacent an axis or rotation 430 for the deck. A central portion of the deck is surrounded by a flange 432 with an opening 434 formed in the flange for allowing low density particles to enter the outlet 428.

With the deck 422 being inclined upwardly in a direction indicated by the arrow 436, riffles 438 are formed on a portion of the deck for further facilitating particle classification and separation according to the invention. Preferably, three sets of straight parallel riffles 440, 442 and 444 are arranged in an upper right hand corner of the deck 422 as viewed in FIG. 14. In other words, the riffle sets 440–444 are on a portion of the deck 422 above the low density outlet 428 and to one side of the deck so that particles being cycled or circulated about the deck by operation in the manner described above, tend to be moving downwardly over the riffles. With the mechanical stops 38' being positioned similarly as in the embodiment of FIGS. 1–4, operation of the concentrator tends to produce clockwise motion of particles. And the riffle sets 440–444 are accordingly positioned as illustrated. Furthermore, a separate high density outlet 446 is mounted on a peripheral portion of the deck 422 for receiving high density particles from of the riffle sets 440–444. The separate outlets 446 may be used to collect different particle cuts or the high density particles received from the three high density outlets may be combined if desired.

An additional riffle or riffle set 448 is further arranged to recycle particles. For that purpose, the riffle set 448 is formed with two straight parallel riffles angling rightwardly and downwardly on the deck 422 as viewed in FIG. 14. With the height of the riffle set 448 being relatively low, only a high density portion of particles is directed to an outward portion of the table with the remaining low density particles tending to spill over the riffle set 448 and thus remain on a radially inner portion of the deck.

Collection of low density particles in the outlet 428 is further facilitated by an additional riffle 450 which is positioned on the deck and is angled radially inwardly and downwardly so that a portion of the low density particles spilling over the riffle set 448 is directed inwardly toward the opening 434 leading to the low density outlet 428. Here again, the height of the riffle 450 may be selected according to the particular application for the concentrator to facilitate its operation.

Otherwise, the concentrator deck 422 of FIGS. 13 and 14 operates in generally a similar manner as described above for the embodiment of FIGS. 1–3. Particles tend to circulate in clockwise fashion about the deck with relatively high density particles moving radially outwardly on the deck and relatively low density particles moving radially inwardly on the deck. As the particles encounter the riffle sets 440–444, relatively heavy particles are directed rightwardly toward the high density outlets 446 with low density particles passing over these riffles and possibly over the riffle set 448 to be directed inwardly by the riffle 450 toward the low density outlet 428.

Here again, it is important to note that the particular configuration of riffles on the flat deck 422 depends upon the particular application and can vary widely in accordance with the contemplated construction and operation according to the present invention.

Still another embodiment of a particle concentrator is illustrated at 500 in FIG. 15. Here again, the particle concentrator 500 of FIG. 15 is identical to that illustrated in FIGS. 1–3 except for construction of its deck. Accordingly, the underlying portions of the concentrator 500, including the base structure, upper support carriage, etc. are not illustrated. In the particle concentrator 500, similar decks 522A and 522B are arranged in stacked relation one upon the other. The lower deck 522A is carried by the upper support carriage 54' with the upper deck 522B mounted upon the lower deck 522A.

The stacked decks in FIG. 15 may be operated either in series or in parallel. As illustrated in FIG. 15, a common central low density particle outlet 524 serves both of the decks. High density particle outlets 526 could be separately provided for the two decks or interconnected in substantially the same manner as the low density particle outlet 524.

Otherwise, the decks 522A and 522B are both of substantially similar design as described above for the deck 22 in FIGS. 1–3 and either FIGS. 4, 5 or 10. With such an arrangement, ore or other particles could be supplied to both decks with capacity of a single concentrator being substantially doubled by the two stacked decks 522A and 522B.

Alternatively, although not specifically shown, it would of course be possible to also operate the stacked decks in series. In such an arrangement, either the high density or low density outlet from one deck, probably the upper deck 522B, would provide the feed particles for the lower deck 522A.

In either operating configuration, riffles and other features of the decks 522A and 522B could be selected to facilitate the intended application for the concentrator.

Still another embodiment of a particle concentrator is indicated at 600 in FIG. 16. Here again, the particle concentrator 600 includes components substantially similar to those described above in FIGS. 1–3 except for the construction of its deck. Accordingly, only a portion of the upper support carriage 54' is illustrated together with the modified deck 622. In this embodiment, the deck is formed as a spiral ribbon so that, with the upper carriage 54' and the deck being subjected to rotary oscillating motion, particle separation could take place along the entire spiral length of the deck. In this embodiment, riffles (not shown) could be radially positioned along the length of the spiral deck so that the spiral deck in effect would function similarly as a shaker table subject to longitudinal vibration. However, the effective length of the concentrator deck would be greatly increased relative to the area occupied by the concentrator. In the spiral embodiment of the deck 622, it would be possible to position the low density particle outlet 628 in a central location as described above for the other embodiments of the present invention. However, in this particular embodiment, it would also be possible to locate the low density and high density particle outlets in other positions upon the deck.

Thus, there have been described above a number of embodiments of particle concentrators constructed according to the present invention. Generally, operation for the different concentrator embodiments, either in a wet or dry mode, is substantially similar.

Initially, the concentrator deck is set into rotary oscillating motion by suitable drive means, preferably the offset eccentric arrangement illustrated in FIG. 2.

Preferably, at least a portion of the deck surface is vertically inclined and formed with riffles to further facilitate and improve particle classification and separation.

Furthermore, it is preferably contemplated that oscillation of the deck be regulated and modulated initially by mechanical stop means limiting oscillating motion of the deck in one direction. With the deck being vertically inclined and formed with riffles as noted above, the mechanical stops are preferably arranged for limiting movement of the deck in a direction so that momentum of relatively high density particles would tend to carry them upwardly and radially outwardly along the riffles while lower density particles would tend to move with the deck surface.

In operation, it is particularly important to note that peripheral portions of the deck experience increased travel relative to central portions of the deck. With an inverted frustoconical deck, as described above the rotary oscillating movement of the deck causes higher density particles to move radially outwardly on the deck toward a peripheral high density outlet with lower density particles moving radially inwardly on the deck toward a centrally arranged low density outlet.

Relatively increased travel of the peripheral portions of the deck further facilitate refinement of high density particles by relatively amplifying their response to oscillating movement of the deck and interaction of the deck with the mechanical stops.

As noted above, a surface portion of the deck is preferably formed with a settling region, a concentrating region and a refining region functioning in the manner described above for further facilitating and improving particle classification and separation.

With the concentrator being adapted for use in a wet mode with its deck submerged under water or another liquid, particles on the deck tend to move substantially through standing water rather than having the water flow or wash over the deck and particles in the manner of prior art concentrators. Thus, the concentrator of the present invention, when employed in a wet mode of operation, tends to achieve particle separation based only on the different specific gravities of the particles and not on their response to flow forces of water washing over them.

The various embodiments and methods of operation described above illustrate a wide variety of constructions and modes of operation according to the present invention. Additional configurations and modes of operation will also be apparent from the preceding description. Accordingly, the scope of the present invention is defined only by the following appended claims.

What is claimed is:

1. A concentrator for separating particles of different densities, comprising:

a concentrator deck being an inverted annular having a frustoconical configuration and movable mounted on a supporting base, outlet means for low density particles formed on a relatively lower central portion of the concentrator deck, output means for high density particles formed on a relatively higher peripheral elevation portion of the concentrator deck.

riffle means angularly formed on the concentrator deck and inclining upwardly and radially outwardly for facilitating separation of particles thereon, drive means for producing rotary oscillating movement of the concentrator deck about an axis perpendicular to the deck and in a direction for accelerating particles upwardly and radially outwardly along the riffles, and stop means for periodically limiting travel of the deck so that momentum of higher density particles propels them more rapidly than lower density particles toward the high density outlet means.

2. The concentrator of claim 1 wherein the drive means comprises at least one eccentric mass mounted on a shaft operatively coupled with the deck by bearing means.

3. The concentrator of claim 2 wherein the shaft extends through the axis of the deck with relatively offset eccentric means secured to opposite end portions of the shaft.

4. The concentrator of claim 2 wherein relatively offset eccentric masses are secured to opposite end portions of the shaft.

5. The concentrator of claim 2 wherein the deck is supported on the base by a plurality of vertically arranged leaf spring permitting rotary oscillating movement of the deck only about its vertical axis.

6. The concentrator of claim 1 adapted for dry operation, the low density particle outlet means comprising a frustoconical element for transferring low density particles from an annular settling area through an axially central outlet means.

7. The concentrator of claim 1 further comprising means for submerging the deck under standing liquid during operation.

8. The concentrator of claim 7 wherein the low density particle outlet means comprises means for introducing liquid onto the deck and means for regulating flow of liquid from the deck with the low density particles, standpipe means regulating height of the standing liquid on the deck above the high density particle outlet means.

9. The concentrator of claim 1 further comprising feeder means for supplying particles of different densities onto a radially outer portion of the inverted annulus.

10. A concentrator for separating particles of different densities, comprising a concentrator deck having an inverted frustoconical configuration, a base providing support for the concentrator deck, drive means for producing rotary oscillating movement of the concentrator deck about an axis perpendicular to the deck, riffle means angularly formed on the concentrator deck for facilitating separation of particles thereon, outlet means for low density particles formed on an axially central portion of the concentrator deck, outlet means for high density particles formed on a peripheral portion of the concentrator deck, the riffle means being formed to facilitate separation of higher density particles from lower density particles and to facilitate radially outwardly movement of the high density particles on the concentrator deck toward the high density particle outlet means, and an annular settling region adjacent the low density outlet means for promoting initial vertical classification of particles according to their density and an annular concentrating region radially outwardly of the settling region for further classifying and causing higher density particles to move radially outwardly toward the high density outlet means, the riffle means being formed in both the annular settling region and the annular concentrating region, annular inclination of the frustoconical concentrator deck, pitch of the riffle means on the deck and height of the riffle means on the deck being selected;

(A) in the settling region for increasing initial vertical classification and transfer of a substantial cut of higher density particles to the concentrating region, and (B) in the concentrating region for further classifying particles, transferring higher density particles radially outwardly toward the high density outlet means and recycling remaining particles toward the settling region to further assure more complete separation of the particles.

11. The concentrator of claim 10 further comprising stop means for limiting travel of the deck in a direction of rotary oscillation selected so that momentum of higher density particles propels them radially outwardly on the riffle means toward the high density outlet means.

12. The concentrator of claim 10 further comprising an annular refining region radially outwardly of the concentrating region for further classifying and causing higher density particles to move radially outwardly toward the high density outlet means, the riffle means also being formed in the annular refining region.

13. The concentrator of claim 12 wherein annular inclination of the deck, pitch of the riffle means on the deck and height of the riffle means are selected:

(A) in the settling region for increasing initial vertical classification and transfer of a substantial cut of higher density particles to the concentrating region, (B) in the concentrating region for further classifying particles, transferring higher density particles radially outwardly toward the high density outlet means and recycling remaining particles toward the setting region to further assure more complete separation of particles, and (C) in the refining region for classifying and transferring only a small, high density cut of the particles to the high density outlet means.

14. The concentrator of claim 13 further comprising scalping means associated with the riffle means for recycling a low density cut of particles to riffle means lower on the deck.

15. The concentrator of claim 13 wherein the annular refining region comprises at least one generally concentric riffle for classifying high density particles and additional refining means at an outlet means of the generally concentric riffle for transferring a high density cut from the generally concentric riffle to the high density cut from the generally concentric riffle to the high density outlet means and for recycling other particles from the generally concentric riffle to a lower riffle means on the deck.

16. The concentrator of claim 15 wherein the additional refining means comprises at least one refining riffle angularly positioned to intercept particles from the outlet means of the generally concentric riffle and to transfer the high density cut to the high density outlet means.

17. A method for separating particles of different densities, comprising the steps of movably mounting an inverted concentrator deck having a frustoconical configuration on a supporting base, providing a low density particle outlet on a relatively lower central portion of the concentrator deck, providing a high density particle outlet on a relatively higher peripheral portion of the concentrator deck, angularly arranging riffle means on the concentrator deck including upwardly and radially outwardly for facilitating separation of particles therein, driving the deck in rotary oscillating motion about a central axis and in a direction accelerating particles upwardly and radially outwardly along the riffles with peripheral portions of the deck traveling increased distances relative to central portions of the deck, rotary oscillation of the deck causing higher density particles to move along the riffle means toward the toward the high density outlet means and facilitating motion of lower density particles toward the low density outlet means, and repetitively limiting oscillating travel of the deck so that momentum of higher density particles propels them along the riffle means toward the high density outlet means.

18. The method of claim 17 further comprising the step of effecting oscillating drive for the deck by means of a shaft extending through the axis of the deck with relatively offset eccentric means secured to opposite ends portions thereof.

19. The method of claim 17 further comprising the step of submerging the deck under standing liquid during operation.

20. A method for separating particles of different densities, comprising the steps of movably mounting a concentrator deck having a frustoconical configuration on a supporting base, providing a low density particle outlet on a relatively lower elevation portion of the concentrator deck, providing a low density particle outlet on a relatively higher elevation portion of the concentrator deck, and angularly arranging riffle means on the concentrator deck for facilitating separation of particles thereon, driving the deck in rotary oscillating motion about a central axis with peripheral portions of the deck traveling increased distances relative to central portions of the deck, rotary oscillation of the deck causing higher density particles to move along the riffle means toward the high density outlet means and facilitating motion of lower density particles toward the low density outlet means, and introducing liquid on the deck, regulating flow of liquid from the deck with the low density particles and regulating height of the standing liquid on the deck above the high density particle outlet means.

21. A concentrator for separating particles of different densities, comprising a concentrator deck having a frustoconical configuration and movably mounted on a supporting base, drive means for producing rotary oscillating movement of the concentrator deck about an axis perpendicular to the deck, riffle means angularly formed on the concentrator deck for facilitating separation of particles thereon, outlet means for low density particles formed on a relatively lower elevation portion of the concentrator deck, outlet means for high density particles formed on a relatively higher elevation portion of the concentrator deck, the riffle means being formed to separate higher density particles from low density particles while facilitating movement of the higher density particles on the concentrator deck toward the relatively higher elevation high density particle outlet means and facilitating movement of the lower density particles on the concentrator deck toward the relatively lower elevation low density particle outlet means in response to rotary oscillating movement of the concentrator deck, stop means for limiting travel of the deck in a direction of rotary oscillation selected so that momentum of higher density particles propels them toward the high density outlet means, and a feeder assembly for supplying particles of different densities to the deck, the feeder assembly being movably mounted on a feeder track rotating with the concentrator deck and propelled in rotary movement relative to the concentrator deck by interaction of the deck with the stop means.

22. A concentrator for separating particles of different densities, comprising a concentrator deck having a frustoconical configuration and movably mounted on a supporting base, drive means for producing rotary oscillating movement of the concentrator deck about an axis perpendicular to the deck, riffle means angularly formed on the concentrator deck or facilitating separation of particles thereon, outlet means for low density particles formed on a relatively lower elevation portion of the concentrator deck, outlet means for high density particles formed on a relatively higher elevation portion of the concentrator deck, the riffle means being formed to separate higher density particles from lower density particles while facilitating movement of the higher density particles on the concentrator deck toward the relatively higher elevation high density particle outlet means and facilitating movement of the lower density particles on the concentrator deck toward the relatively low elevation low density particle outlet means in response to rotary oscillating movement of the concentrator deck, stop means for limiting travel of the deck in a direction of rotary oscillation selected so that momentum of higher density particles propels them toward the high density outlet means, and the frustoconical concentrator deck being an inverted annular with its outer periphery being relatively higher and a relatively lower central opening forming the low density particles outlet means, the riffle means being angularly arranged on the inverted deck annular for transferring high density particles outwardly toward the high density particle outlet means arranged on a peripheral portion of the deck, and feeder means for supplying particles of different densities onto a radially outer portion of the inverted annular, the riffle means comprising principal feed riffles extending substantially from adjacent the central opening to the high density particle outlet means and supplemental recycling riffles arranged in spaced apart relation from the principal feed riffles.

23. A concentrator for separating particles of different densities, comprising a concentrator deck having a frustoconical configuration and movably mounted on a supporting base, drive means for producing rotary oscillating movement of the concentrator deck about an axis perpendicular to the deck, riffle means angularly formed on the concentrator deck for facilitating separation of particles thereon, outlet means for low density particles formed on a relatively lower elevation portion of the concentrator deck, outlet means for high density particles formed on a relatively higher elevation portion of the concentrator deck, the riffle means being formed to separate higher density particles from lower density particles while facilitating movement of the higher density particles on the concentrator deck toward the relatively higher elevation high density particle outlet means and facilitating movement of the lower density particles on the concentrator deck toward the relatively low elevation low density particle outlet means in response to rotary oscillating movement of the concentrator deck, and means for submerging the deck under standing liquid during operation, the low density particle outlet means comprising means for introducing liquid onto the deck and means for regulating flow of liquid from the deck with the low density particles, standpipe means regulating height of the standing liquid on the deck above the high density particle outlet means.

* * * * *

UNITED STATES PATENT AND TRADEMARK OFFICE

CERTIFICATE OF CORRECTION

PATENT NO. : 5,160,035

DATED : November 3, 1992

INVENTOR(S) : David P. McConnell

It is certified that error appears in the above-identified patent and that said Letters Patent is hereby corrected as shown below:

In column 1, line 47, —disclosed— should be inserted after "were".
In column 13, line 35, "2 and 6" should be —6—.
In column 15, line 42, "110" should be —110'—.
In column 17, line 56, "quite" should be —quiet—.
In column 18, line 6, 'form" should be —from—.
In column 23, line 41, after "liquid", the "." should be a —,—.
In column 23, line 60, "annular" should be —annulus—.
In column 23, line 61, "movable" should be —movably—.
In column 23, line 66, "output" should be —outlet—.
In column 24, line 27, "spring" should be —springs—.
In column 24, line 65, "outwardly" should be —outward—.
In column 25, line 47, "setting" should be —settling—.
In column 26, line 14, "including" should be —inclining—.
In column 26, line 15, "therein" should be —thereon—.
In column 26, line 23, "toward the" should be deleted.
In column 26, line 34, "ends" should be —end—.
In column 26, line 44, "low" should be —high—.
In column 26, line 57, "on" should be —onto—.
In column 27, line 10, "low" should be —lower—.
In column 27, line 37, "or" should be —for—.
In column 27, line 51, "low" should be —lower—.
In column 28, line 6, "annular" should be —annulus—.
In column 28, line 8, "particles" should be —particle—.
In column 28, line 10, "annular" should be —annulus—.
In column 28, line 16, "annular" should be —annulus—.
In column 28, line 23, after "comprising" and before "a", a new paragraph should begin.

UNITED STATES PATENT AND TRADEMARK OFFICE

CERTIFICATE OF CORRECTION

PATENT NO. : 5,160,035

DATED : November 3, 1992

INVENTOR(S) : David P. McConnell

It is certified that error appears in the above-indentified patent and that said Letters Patent is hereby corrected as shown below:

Column 28, line 44, "low" should read --lower--.

Signed and Sealed this

Ninth Day of November, 1993

Bruce Lehman

*Attest:*

BRUCE LEHMAN

*Attesting Officer*

*Commissioner of Patents and Trademarks*